US012742261B2

(12) United States Patent
Ikehata et al.

(10) Patent No.: US 12,742,261 B2
(45) **Date of Patent: *Sep. 22, 2026**

(54) LIQUID CRYSTAL POLYESTER FIBERS AND METHOD FOR PRODUCING SAME

(71) Applicant: KURARAY CO., LTD., Kurashiki (JP)

(72) Inventors: Keiichi Ikehata, Kurashiki (JP); Hideki Kamada, Kurashiki (JP); Hideharu Iwasaki, Osaka (JP); Kazuhisa Nakayama, Kurashiki (JP)

(73) Assignee: KURARAY CO., LTD., Kurashiki (JP)

( * ) Notice: Subject to any disclaimer, the term of this patent is extended or adjusted under 35 U.S.C. 154(b) by 238 days.

This patent is subject to a terminal disclaimer.

(21) Appl. No.: 18/200,678

(22) Filed: May 23, 2023

(65) Prior Publication Data

US 2023/0332334 A1 Oct. 19, 2023

Related U.S. Application Data

(63) Continuation of application No. PCT/JP2021/041909, filed on Nov. 15, 2021.

(30) Foreign Application Priority Data

Nov. 25, 2020 (JP) ..... 2020-195469

(51) Int. Cl.
*D01F 6/62* (2006.01)
*D01D 5/084* (2006.01)

(52) U.S. Cl.
CPC ..... *D01F 6/62* (2013.01); *D01D 5/084* (2013.01); *D10B 2331/04* (2013.01)

(58) Field of Classification Search
CPC ..... D01F 6/62
See application file for complete search history.

(56) References Cited

U.S. PATENT DOCUMENTS

| | | | |
|---|---|---|---|
| 4,871,501 | A | 10/1989 | Sugimoto et al. |
| 7,132,383 | B2 | 11/2006 | Nakajima et al. |
| 9,873,835 | B2 | 1/2018 | Saito |
| 2004/0058805 | A1 | 3/2004 | Nakajima et al. |
| 2007/0243376 | A1 | 10/2007 | Tachikawa et al. |
| 2010/0104870 | A1 | 4/2010 | Funatsu et al. |
| 2011/0318982 | A1 | 12/2011 | Funatsu et al. |
| 2012/0021218 | A1 | 1/2012 | Lee et al. |
| 2013/0030143 | A1 | 1/2013 | Saito |
| 2013/0131303 | A1 | 5/2013 | Hosoda et al. |
| 2014/0017965 | A1 | 1/2014 | Kawamata et al. |
| 2015/0004409 | A1 | 1/2015 | Sakae et al. |
| 2016/0340804 | A1 | 11/2016 | Funatsu et al. |
| 2022/0119991 | A1 | 4/2022 | Ikehata et al. |
| 2023/0055144 | A1 * | 2/2023 | Ikehata ..... D01F 6/84 |

FOREIGN PATENT DOCUMENTS

| | | | | |
|---|---|---|---|---|
| CN | 105801824 | A | 7/2016 | |
| CN | 105860445 | A | 8/2016 | |
| CN | 108026258 | A | 5/2018 | |
| EP | 2420600 | B1 | 10/2016 | |
| EP | 3926081 | A1 * | 12/2021 | ..... C08G 63/605 |
| EP | 4092172 | A | 11/2022 | |
| JP | S6118567 | B2 | 5/1986 | |
| JP | S61287922 | A | 12/1986 | |
| JP | H01280031 | A | 11/1989 | |
| JP | H03260114 | A | 11/1991 | |
| JP | 04073227 | A | 3/1992 | |
| JP | H05-085642 | B2 | 12/1993 | |
| JP | H11293522 | A | 10/1999 | |
| JP | 2006089714 | A | 4/2006 | |
| JP | 2011084611 | A | 4/2011 | |
| JP | 2013067779 | A | 4/2013 | |
| JP | 2013237945 | A | 11/2013 | |
| JP | 2016125051 | A | 7/2016 | |
| JP | 2016176161 | A | 10/2016 | |
| JP | 2018040077 | A | 3/2018 | |
| JP | 2018188742 | A | 11/2018 | |
| JP | 2019006973 | A | 1/2019 | |
| JP | 2020105397 | A * | 7/2020 | ..... C08G 63/688 |
| KR | 1020130132754 | A | 12/2013 | |
| KR | 101988184 | B1 | 6/2019 | |
| TW | 572932 | B | 1/2004 | |
| TW | 200902782 | A | 1/2009 | |
| TW | 201245522 | A1 | 11/2012 | |

(Continued)

OTHER PUBLICATIONS

International Search Report issued Jan. 11, 2022 in PCT/JP2021/041909 (with English translation), 4 pages.

(Continued)

*Primary Examiner* — Chanceity N Robinson
(74) *Attorney, Agent, or Firm* — Element IP, PLC

(57) ABSTRACT

A liquid crystal polyester fiber having good mechanical properties and excellent heat aging resistance is obtained by a heat treatment at a low temperature for a short time. The liquid crystal polyester fiber includes one or more metallic elements from Group 8 to Group 11 elements in the Periodic Table. The total content of the metallic element(s) in the liquid crystal polyester fiber can range from 1 to 1000 ppm by weight. The liquid crystal polyester fiber may contain the metallic element(s) as one or more metallic compounds, each having a melting point of $(Mp_0+30)$°C or lower, where $Mp_0$ denotes the melting point of the liquid crystal polyester constituting the fiber.

15 Claims, No Drawings

(56) References Cited

FOREIGN PATENT DOCUMENTS

| | | | | | |
|---|---|---|---|---|---|
| TW | 201546340 | A | | 12/2015 | |
| WO | WO-2002022707 | A1 | | 3/2002 | |
| WO | WO-2012012614 | A2 | | 1/2012 | |
| WO | WO-2013099863 | A1 | | 7/2013 | |
| WO | WO-2017068867 | A1 | * | 4/2017 | ..... C08G 63/60 |
| WO | WO-2017177921 | A1 | | 10/2017 | |
| WO | WO-2020166316 | A1 | * | 8/2020 | ..... C08G 63/605 |
| WO | WO-2020175216 | A1 | | 9/2020 | |
| WO | WO-2020204124 | A1 | * | 10/2020 | ..... C08G 63/78 |
| WO | WO-2020204125 | A1 | | 10/2020 | |

OTHER PUBLICATIONS

K. Oba et al., "Characterization of abnormal structures in thermally treated liquid crystalline aromatic polyesters by pyrolysis-gas chromatography in the presence of organic alkali", Polymer Degradation and Stability 76, 2002, pp. 85 to 94.

English translation of the International Preliminary Report on Patentability and Written Opinion issued Jun. 8, 2023 in PCT/JP2021/041909, 6 pages.

Extended European Search Report issued Nov. 4, 2024, in corresponding European Patent Application No. 21897777.5, 9 pages.

Extended European Search Report issued Oct. 23, 2024, in corresponding European Patent Application No. 21897776.7, 8 pages.

International Preliminary Report on Patentability and Written Opinion issued Jun. 8, 2023, in PCT/JP2021/041910 (with English translation), 12 pages.

International Search Report issued Jan. 11, 2022, in PCT/JP2021/041910 (with English translation), 4 pages.

Office Action issued Sep. 29, 2025, in corresponding Chinese Patent Application No. 202180079435.8 (with English translation), 16 pages.

Polyester Production Technology Q&A, Lu Huibao et al., China Textile Industry Press, Jun. 1993, p. 57 (with AI Produced English Summary).

World Plastics Industry, Institute of Science and Technology Information, Ministry of Chemical Industry, Sep. 1980, p. 202 (with AI Produced English Summary).

* cited by examiner

LIQUID CRYSTAL POLYESTER FIBERS AND METHOD FOR PRODUCING SAME

CROSS REFERENCE TO THE RELATED APPLICATIONS

This application is a continuation application, under 35 U.S.C § 111(a) of international application No. PCT/JP2021/041909, filed Nov. 15, 2021, which claims priority to Japanese patent application No. 2020-195469, filed Nov. 25, 2020, the entire disclosures of all of which are herein incorporated by reference as a part of this application.

FIELD OF THE INVENTION

The present invention relates to a liquid crystal polyester fiber and a method for producing the same.

BACKGROUND ART

A liquid crystal polyester fiber is a synthetic fiber comprising a polymer with a rigid molecular structure, and can be obtained by melt-spinning a liquid crystal polyester. Then, solid phase polymerization by heat treatment of melt-spun fibers of liquid crystal polyester makes it possible to increase the molecular weight of the polymer. Thus-obtained liquid crystal polyester fiber can exhibit very high mechanical properties. The solid phase polymerization process requires a heat treatment at a high temperature for a long time. From the viewpoint of improving productivity, a lot of techniques have been studied to promote a polymerization reaction which raises molecular weights of liquid crystal polyesters at a lower temperature for a shorter time.

With respect to polymerization of liquid crystal polyester, Patent Document 1 (JP Laid-open Patent Publication No. 2013-67779) describes a production method of a liquid crystal polyester comprising a melt-polycondensation of a monomer mixture containing at least one monomer selected from the group consisting of terephthalic acid, a terephthalic acid derivative, 2,6-naphthalene dicarboxylic acid, and a 2,6-naphthalene dicarboxylic acid derivative, by adding a specific heteroaromatic compound as a catalyst. Patent Document 1 describes that the production method can proceed a reaction at a lower temperature for a shorter time.

Patent Document 2 (WO2017/68867) describes a production method of a wholly aromatic polyester comprising a polymerization with a fatty acid metal salt (specifically potassium acetate) as a polymerization catalyst.

RELATED ART DOCUMENT

Patent Document

[Patent Document 1] JP Laid-open Patent Publication No. 2013-67779

[Patent Document 2] WO2017/68867

SUMMARY OF THE INVENTION

Accordingly, although Patent Documents 1 and 2 describe the polymerization catalysts at the time of melt-polymerization in liquid crystal polyester manufactures, none of these documents describes a catalyst for solid phase polymerization of a shaped (for example, melt-spun) article of liquid crystal polyester obtained by melt-polymerization.

More specifically, a basic organic catalyst such as a heteroaromatic compound described in Patent Document 1 may be thermally decomposed during melt-spinning procedure of the liquid crystal polyester which is carried out at a temperature exceeding 250° C., so that the basic organic catalyst cannot be used in the subsequent solid phase polymerization.

The alkali metal ion catalysts described in Patent Document 2 have caused defects, such as a decline of attained strength of fibers as well as a decline of heat aging resistance of fibers after a solid phase polymerization process probably because the alkali metal ion catalysts also function to promote side reactions, such as a depolymerization reaction, depending on increased molecular weight.

Solid phase polymerization process simultaneously generates, other than a polymerization reaction, side reactions which bring about strength reduction, as well as fusion between fibers due to softened fiber surfaces, resulting in phenomenon to spoil flexibility. Therefore, there is a demand for technology to advance polymerization reaction in a selective way at a lower temperature for a shorter time, which contributes to improvement in mechanical properties of fibers.

The present invention is carried out to solve such problems, and to aim at providing liquid crystal polyester fibers excellent in heat aging resistance, while being able to exhibit excellent mechanical properties after being subjected to heat treatment at a lower temperature for a shorter time.

As a result of intensive studies conducted by the inventors of the present invention in an attempt to solve the problem of the conventional technology, the inventors of the present invention have found out that the conventionally used catalyst for melt-polymerization cannot selectively promote reactions in solid phase polymerization probably because of a different mechanism between solid phase polymerization and melt-polymerization. As a result of the further investigation regarding a catalyst suitable for solid phase polymerization, the inventors have found that (i) a catalyst containing specific metallic elements makes it possible to exert excellent mechanical properties of fibers by heat treatment at a lower temperature for a shorter time, and further (ii) such a catalyst can reduce progress of a side reaction, which causes deterioration in strength of fibers, other than a polymerization reaction to a certain degree, so as to improve heat aging resistance of heat-treated fibers after solid phase polymerization, and thus the inventors finally completed the invention.

That is, the present invention may include the following aspects.

Aspect 1

A liquid crystal polyester fiber comprising at least one metallic element selected from the group consisting of metallic elements belonging to from Group 8 to Group II in Periodic Table (preferably at least one metallic element selected from the group consisting of copper, cobalt, and palladium).

Aspect 2

The liquid crystal polyester fiber according to aspect 1, containing the selected one or more metallic elements in a total content of from 1 to 1000 ppm by weight (preferably from 3 to 500 ppm by weight, more preferably from 5 to 200 ppm by weight, and still more preferably from 10 to 100 ppm by weight).

Aspect 3

The liquid crystal polyester fiber according to aspect 1 or 2, wherein the selected one or more metallic elements are contained as one or more metallic compounds each having a melting point of($Mp_0$+30)° C. or lower (preferably ($Mp_0$+

20)° C. or lower), wherein the $Mp_0$ denotes a melting point of a liquid crystal polyester constituting the fiber.

Aspect 4

The liquid crystal polyester fiber according to any one of aspects 1 to 3, having a tenacity of 18 cN/dtex or higher (preferably 20 cN/dtex or higher, and more preferably 23 cN/dtex or higher).

Aspect 5

The liquid crystal polyester fiber according to any one of aspects 1 to 4, wherein a liquid crystal polyester constituting the fiber has a total amount of one-end groups of 20 mEq/kg or less (preferably from 3 to 15 mEq/kg, more preferably from 5 to 13 mEq/kg).

Aspect 6

The liquid crystal polyester fiber according to any one of aspects 1 to 5, wherein a liquid crystal polyester constituting the fiber has a ketone bond amount of 0.05 mol % or less (preferably 0.04 mol % or less, and more preferably 0.02 mol % or less).

Aspect 7

A method to produce the liquid crystal polyester fiber as recited in any one of aspects 1 to 6, comprising:

melt-spinning a resin composition comprising a liquid crystal polyester and at least one metallic element selected from the group consisting of metallic elements belonging to from Group 8 to Group 11 in Periodic Table (preferably at least one metallic element selected from the group consisting of copper, cobalt, and palladium).

Aspect 8

The production method according to aspect 7, wherein the resin composition contains the selected one or more metallic elements in a total content of from 1 to 1000 ppm by weight (preferably from 3 to 500 ppm by weight, more preferably from 5 to 200 ppm by weight, and still more preferably from 10 to 100 ppm by weight).

Aspect 9

The production method according to aspect 7 or 8, wherein the selected one or more metallic elements are contained as one or more metallic compounds each having a melting point of ($Mp_0$+30)° C. or lower (preferably ($Mp_0$+20°) C or lower), wherein the $Mp_0$ denotes a melting point of the liquid crystal polyester.

Aspect 10

The production method according to any one of aspects 7 to 9, wherein an as-spun yarn obtained by the melt-spinning is heat-treated.

Aspect 11

The production method according to aspect 10, wherein the as-spun yarn has a total amount of carboxy end groups (total CEG amount) of 5.0 mEq/kg or less (preferably 4.0 mEq/kg or less, more preferably 3.0 mEq/kg or less, further preferably 2.5 mEq/kg or less, and still more preferably 2.0 mEq/kg or less).

Aspect 12

A fiber structure at least partially comprising the liquid crystal polyester fiber as recited in any one of aspects 1 to 6.

In the present specification, the term "liquid crystal polyester fiber" indicates a fiber comprising a liquid crystal polyester, which includes both an as-spun yarn (as-spun filament) obtained by the melt-spinning before being subjected to heat treatment, and a heat-treated fiber obtained by heat-treating such an as-spun yarn.

The present invention encompasses any combination of at least two features disclosed in the claims and/or the specification and/or the drawings. In particular, any combination of two or more of the appended claims should be equally construed as included within the scope of the present invention.

Effect of the Invention

The liquid crystal polyester fibers of the present invention can exhibit excellent mechanical properties (dynamics physical properties) by heat treatment at a lower temperature for a shorter time. The liquid crystal polyester fiber after being subjected to heat treatment is excellent in heat aging resistance.

DETAILED DESCRIPTION OF THE INVENTION

Liquid Crystal Polyester Fiber

The liquid crystal polyester fiber according to the present invention comprises a liquid crystal polyester. The liquid crystal polyester comprises repeating structural units originating from, for example, aromatic diols, aromatic dicarboxylic acids, aromatic hydroxycarboxylic acids, etc. As long as the effect of the present invention is not spoiled, the repeating structural units originating from aromatic diols, aromatic dicarboxylic acids, and aromatic hydroxycarboxylic acids are not limited to a specific chemical composition. The liquid crystal polyester may include the structural units originating from aromatic diamines, aromatic hydroxy amines, or aromatic aminocarboxylic acids in the range which does not spoil the effect of the present invention. For example, preferable structural units may include units shown in Table 1.

TABLE 1

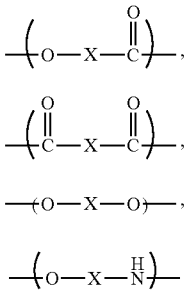

In the formula, X is selected from the following

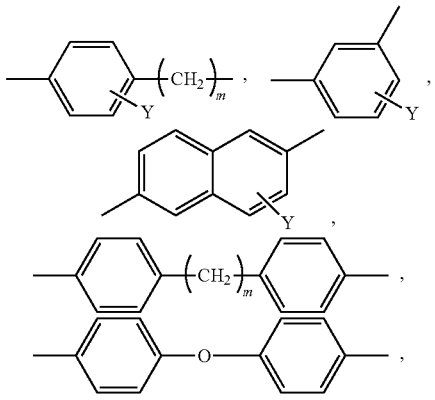

-continued

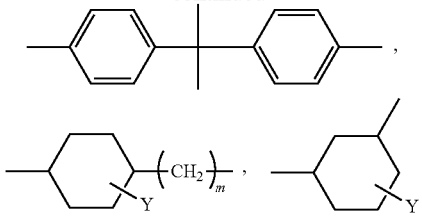

In the structural units in Table 1, m is an integer from 0 to 2, and Y in the formula independently represents, as from one substituent to the number of substituents in the range of the replaceable maximum number of aromatic ring, a hydrogen atom, a halogen atom (for example, fluorine atom, chlorine atom, bromine atom and iodine atom), an alkyl group (for example, an alkyl group having 1 to 4 carbon atoms such as methyl group, ethyl group, isopropyl group and t-butyl group), an alkoxy group (for example, methoxy group, ethoxy group, isopropoxy group, n-butoxy group, etc.), an aryl group (for example, phenyl group, naphthyl group, etc.), an aralkyl group [for example, benzyl group (phenylmethyl group), phenethyl group (phenylethyl group), etc.], an aryloxy group (for example, phenoxy group etc.), an aralkyloxy group (for example, benzyloxy group etc.), and others.

As more preferable structural units, there may be mentioned structural units as described in Examples (1) to (18) shown in the following Tables 2, 3, and 4. It should be noted that where the structural unit in the formula is a structural unit which can show a plurality of structures, combination of two or more units may be used as structural units for a polymer.

TABLE 2

(1)

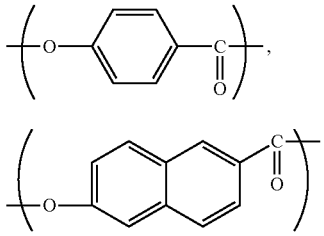

(2)

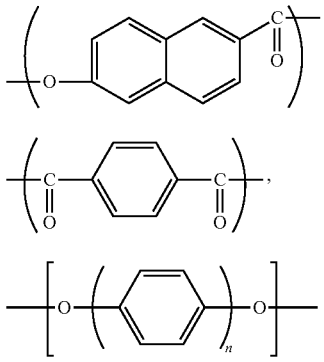

(3)

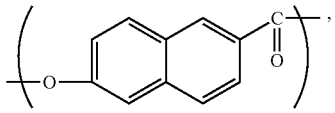

TABLE 2-continued

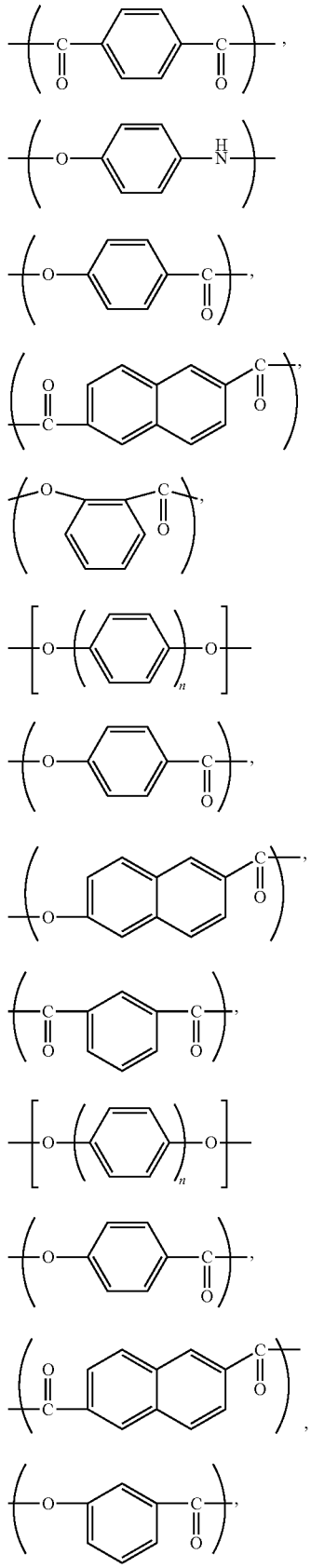

(4)

(5)

(6)

TABLE 2-continued
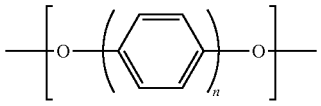
(7)
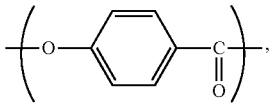
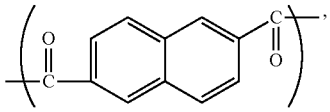
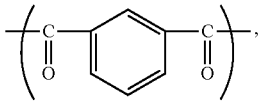
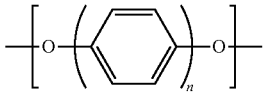
(8)
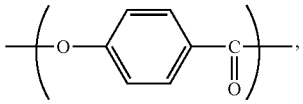
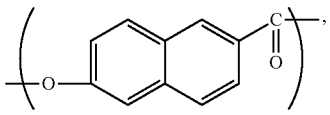
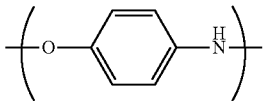
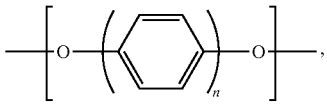
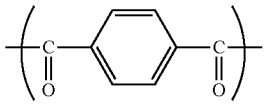
TABLE 3
(9)
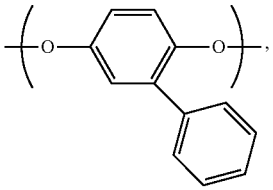
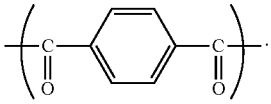
TABLE 3-continued
(10)
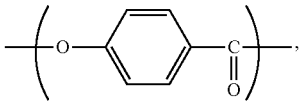
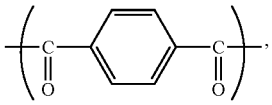
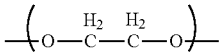
(11)
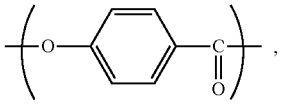
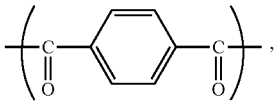
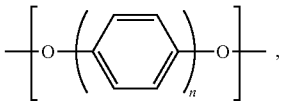
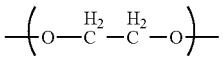
(12)
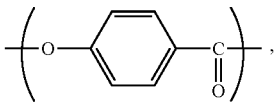
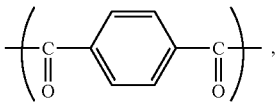
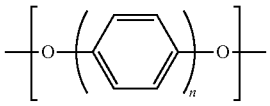
(13)
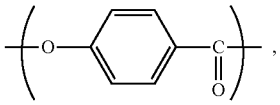
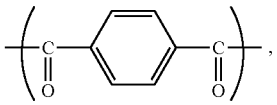
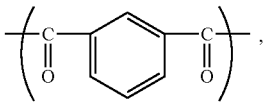
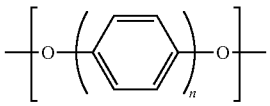

TABLE 3-continued (14)

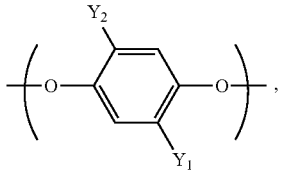

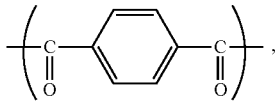

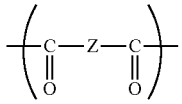

(15)

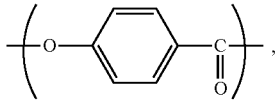

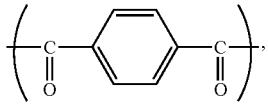

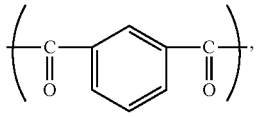

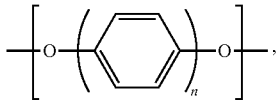

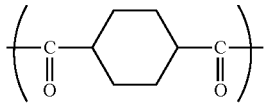

TABLE 4

(16)

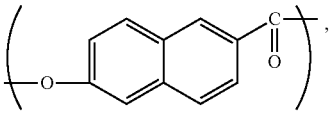

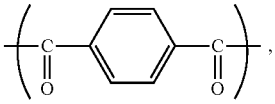

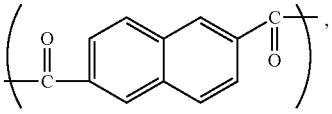

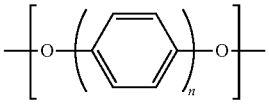

TABLE 4-continued (17)

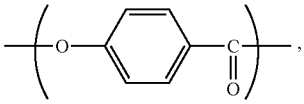

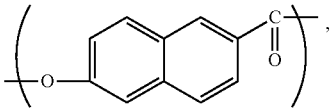

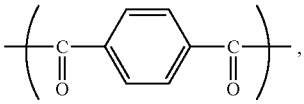

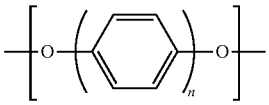

(18)

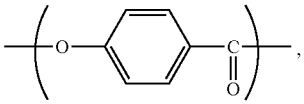

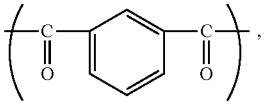

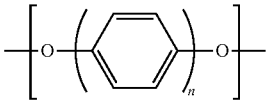

In the structural units shown in Tables 2, 3, and 4, n is an integer of 1 or 2, among each of the structural units, n=1 and n=2 may independently exist, or may exist in combination; each of the $Y_1$ and $Y_2$ independently represents, a hydrogen atom, a halogen atom (for example, fluorine atom, chlorine atom, bromine atom, iodine atom, etc.), an alkyl group (for example, an alkyl group having 1 to 4 carbon atoms such as methyl group, ethyl group, isopropyl group, and t-butyl group, etc.), an alkoxy group (for example, methoxy group, ethoxy group, and isopropoxy group, n-butoxy group, etc.), an aryl group (for example, phenyl group, naphthyl group, etc.), an aralkyl group [for example, benzyl group (phenylmethyl group), phenethyl group (phenylethyl group), etc.], an aryloxy group (for example, phenoxy group etc.), an aralkyloxy group (for example, benzyloxy group etc.), and others. Among these, the preferable one may include a hydrogen atom, a chlorine atom, a bromine atom, and a methyl group.

Z may include substitutional groups denoted by following formulae.

Chem. 1

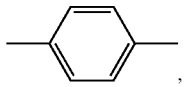

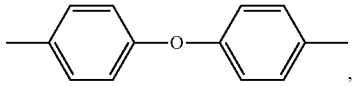

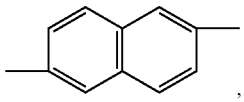

-continued

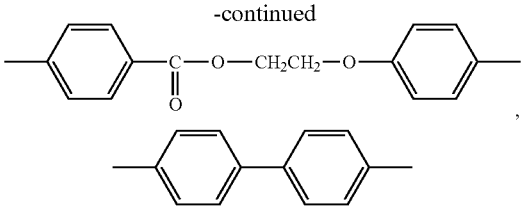

Preferable liquid crystal polyester may comprise a combination of a structural unit having a naphthalene skeleton. Especially preferable one may include both the structural unit (A) derived from hydroxybenzoic acid and the structural unit (B) derived from hydroxy naphthoic acid. For example, the structural unit (A) may have a following formula (A), and the structural unit (B) may have a following formula (B). In order to improve melt-formability, the ratio of the structural unit (A) and the structural unit (B) may preferably be in a range of former/latter of 9/1 to 1/1, more preferably from 7/1 to 1/1, and still more preferably from 5/1 to 1/1.

Chem. 2

(A)

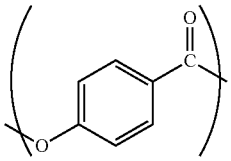

Chem. 3

(B)

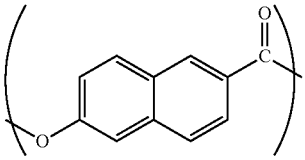

The total proportion of the structural units of (A) and (B) may be, based on all the structural units, for example, 65 mol % or more, more preferably 70 mol % or more, and further preferably 80 mol % or more. A liquid crystal polyester having the structural unit (B) at a proportion of 4 to 45 mol % is especially preferred among polymers.

The liquid crystal polyester may also contain a structural unit derived from 4-hydroxybenzoic acid as an aromatic hydroxycarboxylic acid, a structural unit derived from an aromatic dicarboxylic acid and a structural unit derived from an aromatic diol. For example, the structural unit derived from aromatic dicarboxylic acid may be at least one unit selected from the group consisting of the following formulae (C) and (D). The structural unit derived from aromatic diol may be at least one unit selected from the group consisting of the following formulae (E) and (F). Preferable one may include a liquid crystal polyester comprising a structural unit (A) derived from 4-hydroxybenzoic acid (formula (A) above), a structural unit (C) derived from terephthalic acid (formula (C) below) and a structural unit (D) derived from isophthalic acid (formula (D) below) as an aromatic dicarboxylic acid, and a structural unit (E) derived from 4,4'-dihydroxybiphenyl (formula (E) below) as an aromatic diol, and a liquid crystal polyester comprising a structural unit (A) derived from 4-hydroxybenzoic acid (formula (A) above), a structural unit (C) derived from terephthalic acid (formula (C) below) and a structural unit (D) derived from isophthalic acid (formula (D) below) as an aromatic dicarboxylic acid, and a structural unit (E) derived from 4,4'-dihydroxybiphenyl (formula (E) below) and a structural unit (F) derived from hydroquinone (formula (F) below) as an aromatic diol, and the like.

Chem. 4

(C)

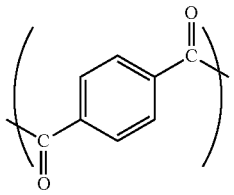

Chem. 5

(D)

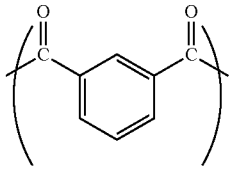

Chem. 6

(E)

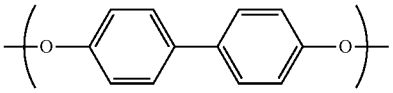

Chem. 7

(F)

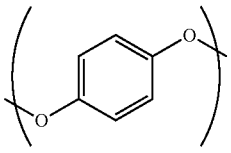

The liquid crystal polyester may contain a structural unit derived from 4-hydroxybenzoic acid, preferably at a proportion of 50 mol % or more, more preferably 53 mol % or more, and even more preferably 60 mol % or more. The upper limit of the content of the structural unit derived from 4-hydroxybenzoic acid in the liquid crystal polyester is not particularly limited, and may be, for example, 90 mol % or less, preferably 88 mol % or less, and more preferably 85 mol % or less.

The liquid crystal polyester suitably used in the present invention may preferably have a melting point (hereinafter sometimes referred to as $Mp_0$) in the range from 250 to 380° C., more preferably from 255 to 370° C., further preferably from 260 to 360° C., and even more preferably from 260 to 330° C. The melting point here refers to a main endothermic peak temperature determined and observed using a differential scanning ealorimeter (DSC; "TA3000" produced by Mettler-Toledo International Inc.) in accordance with the JIS K 7121 test method. Specifically, 10 to 20 mg of a sample is encapsulated in an aluminum pan and taken into the aforementioned DSC device. Then the temperature is elevated at a rate of 20° C./min with supplying nitrogen as a carrier gas at a flow rate of 100 mL/min to measure an endothermic peak. Depending on the type of polymer, some polymers may not show a clear peak in the 1st run of DSC measurement. If no clear peak appears in the 1st run of DSC measurement, the sample is heated up to a temperature 50° C. higher than the expected flow temperature in a temperature elevation rate of 50° C./min. After keeping the temperature for 3 minutes so as to make the sample completely molten, the sample is cooled at a cooling rate of 80° C./min to 50° C., and then is elevated at 20° C./min to measure the endothermic peak thereof.

It should be noted that the liquid crystal polyester may be used with thermoplastic polymers, such as a polyethylene terephthalate, a modified-polyethylene terephthalate, a polyolefin, a polycarbonate, a polyamide, a polyphenylene sulfide, a polyether ether ketone, a fluoro-resin, and others, as long as they do not spoil the effect of the present invention. A variety of additives may also be added, including inorganic substances such as titanium oxide, kaolin, silica, and barium oxide; carbon black; a colorant such as dyes and paints; an antioxidant; an ultraviolet-ray absorbent; and a light stabilizer.

The liquid crystal polyester fiber of the present invention contains at least one metallic element selected from the group consisting of metallic elements belonging to Group 8 to Group 11 in Periodic Table. The liquid crystal polyester fiber of the present invention may preferably contain at least one metallic element selected from the group consisting of metallic elements belonging to Group 8 to Group 11 and Period 4 to Period 6 in Periodic Table. More concretely, the metallic element may be at least one metallic element selected from the group consisting of iron, ruthenium, osmium, cobalt, rhodium, iridium, nickel, palladium, platinum, copper, silver, and gold. Since such a specific metallic element enables to proceed solid phase polymerization reaction thanks to the catalytic action thereof, the as-spun yarn of the liquid crystal polyester fiber containing such a metallic element as a solid phase polymerization catalyst can be heat-treated at a lower temperature for a shorter time to exhibit excellent mechanical properties. The metallic element can also proceed a target polymerization reaction in a selective way, while suppressing progress of a side reaction, which causes deterioration in strength of fibers, to some extent other than the polymerization reaction. As a result, the heat-treated fiber of the liquid crystal polyester containing such a metallic element is excellent in heat aging resistance, namely, i.e., the fiber can control deterioration in mechanical properties even if the fiber is kept under hot environment for a long time.

From the viewpoint of advancing polymerization reaction in solid phase polymerization, the metallic element contained in the liquid crystal polyester fiber of the present invention may be more preferably at least one metallic element selected from the group consisting of copper, cobalt, and palladium, and, still more preferably copper.

The above-mentioned metallic element may be contained as a metallic compound having a structure in which a metal atom is bonded with a non-metal atom. Examples of metallic compounds may include organic acid salts such as a formate, an acetate, a propionate, a butanoate, a valerate, a caproate, an enanthate, a caprylate, a pelargonate, a caprate, a laurate, a myristate, a palmitate, a stearate, a naphthenate, a benzoate, an oxalate, a malonate, a succinate, an adipate, a terephthalate, an isophthalate, a phthalate, a salicylate, a tartrate, a citrate, a fluoroacetate, a chloroacetate, a bromoacetate, a fluoropropionate, a chloropropionate, and a bromopropionate; inorganic acid salts, such as a sulfate, a carbonate, and a nitrate; halides such as a fluoride, a chloride, a bromide, and an iodide; hydroxides; oxides; sulfides; and others. These metallic compounds may be used singly, or in combination of two or more. Among these metallic compounds, from the viewpoint of having improved dispersibility into a fiber as well as a low melting point, preferable metallic compounds may include, for example, organic acid salts, inorganic acid salts, halides, and hydroxides.

As long as the metallic compound can act as a solid phase polymerization catalyst, the species of the metallic compound is not specifically limited, and the metallic compound may be preferably a metallic compound which acts as a catalyst for decarboxylation reaction of aromatic carboxylic acid. From the viewpoint of the acceleration of polymerization reaction in solid phase polymerization, the metallic compound may be a metal complex compound in which a metal atom makes a coordinate bond with a ligand. As long as the ligand is capable of coordinating to a metal atom in the metallic compound, the species of the ligand is not specifically limited, and examples of the ligands may include a nitrogen-based ligand, an oxygen-based ligand, a carbon-based ligand, a phosphorus-based ligand, a sulfur-based ligand, and other ligands. In the metallic compound, the metal atom may make a coordinate bond to a ligand, such as an organic acid corresponding to the organic acid salt, an inorganic acid corresponding to the inorganic acid salt, and a halogen corresponding to the halide.

As long as the nitrogen-based ligand is a ligand with a nitrogen atom capable of coordinating to the metal atom in the metallic compound, the species of the nitrogen-based ligand is not specifically limited, and examples of the nitrogen-based ligands may include amine-based ligands such as ammine ($NFH_3$), aniline, diisopropylamine, triethylamine, triphenylamine, hexamethyldisilazane, diazabicycloundecene, ethylenediamine (en), 2,3-butanediamine, N,N,N',N'-tetramethylethylenediamine, ethylenediaminetetraacetic acid (edta), diethylenetriamine, N,N,N',N'',N''-pentamethyldiethylenetriamine, 1,4,7-triazacyclononane, triethylenetetramine, tris(2-aminoethyl)amine, and hexamethylenetetramine; nitrogen-containing heteroaromatic ligands such as pyrrole, pyridine (py), dimethylpyridine, bipyridine (bpy), terpyridine, imidazole, pyrazole, pyrazine, pyrimidine, triazole, quinoline, isoquinoline, acridine, 1,8-naphthyridine, phenanthroline (phen), 2,9-dimethyl-1,10-phenanthroline, 4,7-diphenyl-1,10-phenanthroline, 2,9-diphenyl-1,10-phenanthroline, 2,9-dimethyl-4,7-diphenyl-1,10-phenanthroline, dimethylaminopyridine, and porphyrin; nitrile-based ligands such as acetonitrile and benzonitrile; cyanide ($CN^-$); isothiocyanide ($NCS^-$); nitrosyl (NO); and other ligands.

As long as the oxygen-based ligand is a ligand with an oxygen atom capable of coordinating to the metal atom in the metallic compound, the species of the oxygen-based ligand is not specifically limited, and examples of the oxygen-based ligands may include ether-based ligands such as dimethyl ether, diethyl ether, tetrahydrofuran, 1,4-dioxane, and 1,2-dimethoxyethane; alcohol-based ligands such as methanol, ethanol, phenol, and 1,1'-binaphthalene-2,2'-diol; acyl-based ligands such as carboxylato ($RCOO^-$), oxalato ($ox^{2-}$), and acetylacetonate (acac); aqua ($H_2O$); hydroxide ($OH^-$); oxo ($O^{2-}$); and other ligands.

As long as the carbon-based ligand is a ligand with a carbon atom capable of coordinating to the metal atom in the metallic compound, the species of the carbon-based ligand is not specifically limited, and examples of the carbon-based ligands may include alkyl-based ligands such as methyl; aryl-based ligands such as phenyl; vinyl-based ligands; alkynyl-based ligands; carbene-based ligands such as N-heterocyclic carbene; alkene-based ligands such as ethylene, dibenzylideneacetone (dba); alkyne-based ligands such as acetylene and 2-phenylethynylbenzene; cyclopentadiene-based ligands such as cyclopentadiene and pentamethylcyclopentadiene; diene-based ligands such as 1,3-butadiene and 1,5-cyclooctadiene (cod); cyclic polyene-based ligands such as benzene and cyclooctatetraene; isocyanide-based ligands such as cyanomethyl isocyanide, and phenyl isocyanide; carbonyl (CO); and other ligands.

As long as the phosphorus-based ligand is a ligand with a phosphorus atom capable of coordinating to the metal atom in the metallic compound, the species of the phosphorus-based ligand is not specifically limited, and examples of the phosphorus-based ligands may include phosphine-based ligands such as triphenylphosphine, tris(2-methylphenyl) phosphine, tris(2-methoxyphenyl)phosphine, di-tert-butylphenylphosphine, trimethylphosphine, tri-tert-butylphosphine, tricyclohexylphosphine, bis (diphenylphosphino)methane (dppm), 1,2-bis (diphenylphosphino)ethane (dppe), 1,3-bis (diphenylphosphino)propane (dppp), 2,2'-bis (diphenylphosphino)-1,1'-binaphthyl (BINAP), 2-dicyclohexylphosphino-2',6'-dimethoxybiphenyl (SPhos), 2-dicyclohexylphosphino-2',4',6'-triisopropylbiphenyl (XPhos), 2-dicyclohexylphosphino-2'-methylbiphenyl (MePhos), 2-dicyclohexylphosphino-2'-(N,N-dimethylamino) biphenyl (DavePhos), and 2-(di-tert-butylphosphino)biphenyl (JohnPhos); and other ligands.

As long as the sulfur-based ligand is a ligand with a sulfur atom capable of coordinating to the metal atom in the metallic compound, the species of the sulfur-based ligand is not specifically limited, and examples of the sulfur-based ligands may include thiol-based ligands; sulfoxide-based ligands such as dimethyl sulfoxide (DMSO); sulfur-containing heteroaromatic ligands such as thiophene, dibenzothiophene, and thiopyran; thiocyanide ($SCN^-$); sulfide ($S^{2-}$); and other ligands.

Although a desirable ligand varies depending on a species of metal atom, in the case of copper, from the viewpoint of the acceleration of polymerization reaction in solid phase polymerization, a copper atom may be preferably coordinated with a nitrogen-based ligand, more preferably with a nitrogen-containing heteroaromatic ligand or nitrogen-based chelate ligand, and still more preferably with a nitrogen-containing heteroaromatic chelate ligand. Here, the chelate ligand is a ligand which is bidentate or more multidentate and has a plurality of coordination sites in a molecule, and is in a position where a plurality of coordination sites of the ligand can coordinate to one metal atom at one time. Examples of the nitrogen-based chelate ligands may include ethylenediamine, diethylenetriamine, triethylenetetramine, tris(2-aminoethyl)amine, hexamethylenetetramine, bipyridine, terpyridine, phenanthroline, and derivatives thereof.

The valence of copper in a copper compound may be any of zerovalency, monovalency and divalency, and from the viewpoint of suppressing the condensation and localization during melt-spinning, the valence of copper may be preferably monovalent or divalent. From the viewpoint of the acceleration of polymerization reaction in solid phase polymerization, the valence of copper may be more preferably monovalent.

In the case of cobalt, from the viewpoint of the stability under the atmosphere at the time of use and the acceleration of polymerization reaction in solid phase polymerization, a cobalt atom may be preferably coordinated with an oxygen-based ligand, and more preferably with an acyl-based ligand.

In the case of palladium, from the viewpoint of the stability under the atmosphere at the time of use and the acceleration of polymerization reaction in solid phase polymerization, a palladium atom may be preferably coordinated with an oxygen-based ligand, and more preferably with an acyl-based ligand (e.g., carboxylato (preferably acetate and trifluoroacetato)).

The liquid crystal polyester fiber of the present invention can suitably determine a content of a metallic element depending on metallic element species, and for example, from the viewpoint of achieving both acceleration of polymerization reaction and control of side reaction in solid phase polymerization, the liquid crystal polyester fiber may contain the above-mentioned metallic element at a total content of from 1 to 1000 ppm by weight, preferably from 3 to 500 ppm by weight, more preferably from 5 to 200 ppm by weight, and still more preferably from 10 to 100 ppm by weight. The content of the metallic element indicates a ratio of the total weight of the above-mentioned metallic elements based on the total weight of liquid crystal polyester fiber. Where a metallic element(s) is(are) contained as the above-mentioned metallic compound(s), the content of the metallic element indicates a value converted as a content of metal atom. Here, the above-mentioned content of the metallic element may be a content of the metallic element in the component which constitutes the fiber itself, excluding a component adhering to fiber surfaces such as an oil agent.

From the viewpoint of control of side reactions in solid phase polymerization, the liquid crystal polyester fiber of the present invention may have a content of an alkaline metal and an alkaline-earth metal in total of less than 100 ppm by weight, preferably 10 ppm by weight or less, more preferably 5 ppm by weight or less, and still more preferably 1 ppm by weight or less. Here, the content of the alkaline metal and the alkaline-earth metal may be a content of the alkaline metal and the alkaline-earth metal in the component which constitutes the fiber itself, excluding a component adhering to fiber surfaces, such as an oil agent. In the present specification, the alkaline metal indicates either one of lithium, sodium, potassium, rubidium, cesium, and francium, and the alkaline-earth metal indicates either one of beryllium, magnesium, calcium, strontium, barium, and radium.

The liquid crystal polyester fiber of the present invention may contain a liquid crystal polyester at a proportion of 50 wt % or more, preferably 80 wt % or more, more preferably 90 wt % or more, still more preferably 95 wt % or more, and further more preferably 99.9 wt % or more.

The as-spun yarn of the liquid crystal polyester fiber according to the present invention may have a total amount of carboxy end groups (total CEG amount) of 5.0 mEq/kg or less. Although the relationship how the carboxy groups at the molecular terminals of the liquid crystal polyesters exert effect on the reaction in solid-phase polymerization is not clear, it is thought that the reduced amounts of carboxy groups at the molecular terminals may be one factor to activate reactions in solid phase polymerization, such that as-spun yarns with low total amount of carboxy end groups can exhibit excellent mechanical properties with a heat treatment at a lower temperature and a shorter time. The as-spun yarn of the liquid crystal polyester fiber may preferably have a total amount of carboxy end groups (total CEG content) of 4.0 mEq/kg or less, more preferably 3.0 mEq/kg or less, even more preferably 2.5 mEq/kg or less, and even more preferably 2.0 mEq/kg or less. The total amount of carboxy end groups (total CEG amount) is a value measured by the method described in the Examples below, and is defined as the amount of carboxy end groups of polymer molecules in 1 kg of fiber, the polymer molecules mainly constituting the liquid crystal polyester fiber. For example, as the carboxy end groups in liquid crystal polyester, there may be exemplified carboxy groups that do not participate in reaction and remain in the terminal structural units derived from monomers having carboxy groups, such as aromatic hydroxycarboxylic acids and aromatic dicarboxylic acids.

The as-spun yarn of the liquid crystal polyester fiber of the present invention may have a total amount of one-end groups of 50 mEq/kg or more, preferably 55 mEq/kg or more, and more preferably 60 mEq/kg or more. The total amount of one-end groups may be 200 mEq/kg or lower, and preferably 100 mEq/kg or lower. The term "total amount of one-end groups" indicates the number of polymer chains, and is used as an index by which a molecular weight is evaluated. There is a tendency that the larger the total amount of one-end groups is, the smaller the molecular weight is; while the smaller the total amount of one-end groups is, the larger the molecular weight is. Considering difficulty to quantify all kinds of end groups constituting the liquid crystal polyester depending on the monomer constitution of the liquid crystal polyester, the present invention defines that the total amount of one-end groups is a value obtained by dividing a total amount (mEq/kg) of end groups by a molar ratio of structural units derived from the hydroxycarboxylic acids in the liquid crystal polyester, in which the total amount (mEq/kg) of end groups is a value of (i) carboxy end groups derived from hydroxycarboxylic acids and (ii) end groups from which carbon dioxide was eliminated by decarboxylation reaction from carboxy groups derived from hydroxycarboxylic acids in 1 kg of the liquid crystal polyester fibers. The total amount of one-end groups can be measured by the method described in the Examples below. As described above, where an as-spun yarn with relatively large total amount of one-end groups is heat-treated, solid phase polymerization of the as-spun yarn can be advanced so as to decrease a total amount of one-end groups (i.e., increase a molecular weight).

The as-spun yarn of the liquid crystal polyester fiber of the present invention can exhibit excellent mechanical properties due to heat treatment at a low temperature for a short time. In general, heat treatment of the as-spun yarn of liquid crystal polyester fiber requires for a long time (for example, about 20 hours) to improve mechanical properties. Accordingly, even if shortening of heat treatment time is desired, it is necessary to carry out step-wise heat treatment by raising temperatures stepwisely for heat treatment at a high temperature of a melting point of a liquid crystal polyester fiber or higher because the melting point of the liquid crystal polyester fiber is increased along with advance of solid phase polymerization. According to the present invention, where the tenacity of the as-spun yarn of the liquid crystal polyester fiber is, for example, 12 cN/dtex or less, it is possible to obtain a heat-treated fiber with a tenacity of 18 cN/dtex or more by heat treatment at a low temperature for a short time. The low temperature and the short time conditions of heat treatment may be varied depending on heat treatment procedures as well as the amount of as-spun yarn to be subjected to heat treatment, and for example, heat treatment using batch processing at a temperature of lower than a melting point (Mp) of an as-spun yarn of a liquid crystal polyester fiber for 3 hours or less makes a heat-treated fiber to have a tenacity of 18 cN/dtex or more, preferably 20 cN/dtex or more, and more preferably 23 cN/dtex or more. In the present invention, a liquid crystal polyester fiber with a tenacity of 12 cN/dtex or less may be regarded as an as-spun yarn, while a liquid crystal polyester fiber with a tenacity exceeding 12 cN/dtex may be regarded as a heat-treated fiber.

The heat-treated fiber of the liquid crystal polyester fiber of the present invention may have a tenacity of 18 cN/dtex or more, preferably 20 cN/dtex or more, and more preferably 23 cN/dtex or more. Although upper limit of the tenacity is not particularly limited, the upper limit may be, for example, about 40 cN/dtex. Here in the present specification, the tenacity of the liquid crystal polyester fiber refers to a tensile strength, and is a value measured by the method described in the Examples below.

In view of improvement in mechanical properties such as tenacity, the heat-treated fiber of the liquid crystal polyester fiber according to the present invention preferably has a higher molecular weight, and the heat-treated fiber may have, for example, a total amount of one-end groups of 20 mEq/kg or less, preferably 15 mEq/kg or less, and more preferably 13 mEq/kg or less. Although the lower limit of the total amount of one-end groups is not particularly limited, the total amount of one-end group may be, for example, 3 mEq/kg or more, and preferably 5 mEq/kg or more.

In view of improvement in mechanical properties such as tenacity, the heat-treated fiber of the liquid crystal polyester fiber according to the present invention preferably has a ketone bond amount of 0.05 mol % or less, preferably 0.04 mol % or less, and more preferably 0.02 mol % or less. In the present invention, the term ketone bond amount indicates a ratio of a molar amount of ketone bond amount based on a total molar amount of ester bond and ketone bond amounts, and is a value measured by the method described in the Examples below. Too much ketone bond amount may probably make linearity of polymer declined, and there is a tendency for the liquid crystal polyester fiber with a too much ketone bond amount to have a reduced tenacity. Although the lower limit of the ketone bond amount is not particularly limited, the ketone bond amount may be, for example, 0.005 mol % or more.

The heat-treated liquid crystal polyester fiber according to the present invention may have a melting point of from 290 to 400° C., preferably from 300 to 380° C., and more preferably from 305 to 350° C. The liquid crystal polyester fiber may have a melting point increased from the melting point (Mp) of the as-spun yarn by solid phase polymerization. The melting point of the liquid crystal polyester fiber is a value measured by the method described in the Examples below.

The heat-treated liquid crystal polyester fiber of the present invention is excellent in heat aging resistance, so that the heat-treated liquid crystal polyester fiber may have a tenacity retention percentage of 70% or more, preferably 80% or more, and more preferably 85% or more after heated at 250° C. for 100 hours. Further, the heat-treated liquid crystal polyester fiber may have a tenacity retention percentage of 50% or more, preferably 60% or more, and more preferably 65% or more after heated at 250° C. for 300 hours. Since it is preferred that, as for the heat-treated fiber, tenacity has become high enough by solid phase polymerization, the tenacity retention percentage at the time of heating at 250° C. for 100 hours or 300 hours may be 100% or less. The tenacity retention percentage of a heat-treated fiber is a value measured by the method described in the Examples below.

The liquid crystal polyester fiber according to the present invention may have an adjusted single fiber fineness depending on the application, etc. The single fiber fineness, for example, may be 0.5 to 50 dtex, preferably from 1.0 to 35 dtex, more preferably 1.0 to 15 dtex, and even more preferably 1.5 to 10 dtex.

The liquid crystal polyester fiber according to the present invention may be a monofilament or a multifilament. In the case of multifilament, the number of filaments may be adjusted depending on the application, etc. For example, the number of filaments may be 5 to 5000 filaments, preferably 10 to 4000 filaments, and more preferably 30 to 3000 filaments.

The total fineness of the liquid crystal polyester fiber can be adjusted depending on the application, etc. For example, the total fineness may be 10 to 50000 dtex, preferably from 15 to 30000 dtex, and more preferably 25 to 10000 dtex.

Method for Producing Liquid Crystal Polyester Fiber

A method to produce the liquid crystal polyester fiber according to the present invention may comprise: melt-spinning a resin composition comprising a liquid crystal polyester and at least one metallic element selected from the group consisting of metallic elements belonging to from Group 8 to Group 11 in Periodic Table to obtain an as-spun yarn.

The resin composition may comprise the liquid crystal polyester as described above and at least one metallic element selected from the group consisting of metallic elements belonging to from Group 8 to Group 11 in Periodic Table. Although the configuration of the metallic element to be contained is not particularly limited, the metallic element may be contained as the metallic compound as described above.

From the viewpoint of compatibilizing both acceleration of polymerization reaction and suppression of side reaction in solid phase polymerization, the resin composition may contain the above metallic element at a total content of from 1 to 1000 ppm by weight, preferably from 3 to 500 ppm by weight, more preferably from 5 to 200 ppm by weight, and still more preferably from 10 to 100 ppm by weight. The content of the metallic element in the resin composition indicates a ratio of the total weight of the metallic element(s) to be added based on the total weight of the resin composition containing the liquid crystal polyester and the metallic element(s). In the case of containing a metallic element(s) as the above-mentioned metallic compound(s), the content of the metallic element indicates a value converted as a content of a metal atom.

The metallic compound may be a metal complex compound as described above from the viewpoint of the acceleration of polymerization reaction in solid phase polymerization. In such a case, as a configuration to be added to a resin composition, a metal complex compound in the state where a ligand is already coordinated may be added to a resin. Alternatively, a metallic compound and a compound being capable of forming a ligand may be separately added to resin.

From the viewpoint of improvement in longer operability for melt-spinning and improvement in dispersibility into resin, the metallic compound may be a compound having a melting point of $(Mp_0+30)$° C. or lower, wherein the $Mp_0$ denotes a melting point of the liquid crystal polyester. In the melt-spinning process, the resin composition is heated to be melted at a temperature of the melting point ($Mp_0$) of the liquid crystal polyester or higher. Since the catalytic action of the metallic element in the resin composition can advance reactions in connection with solid phase polymerization to some extent even in this stage, it is preferred to melt both the metallic compound and the liquid crystal polyester in the resin composition so as to accelerate the reactions. The upper limit of the melting point of the metallic compound may be preferably $Mp_0+20$° C. or lower.

The melting point of the metallic compound may be preferably 400° C. or lower, and more preferably 350° C. or lower from the viewpoint of processability. Although the lower limit of the melting point of the metallic compound is not particularly limited, the lower limit may be preferably 100° C. or higher considering handleability around the melt spinning machine.

The melt-spinning can be carried out in a publicly known or conventional method. For example, a resin composition melted in an extrusion machine can be discharged from a spinneret at a predetermined spinning temperature so that an as-spun yarn may be wound using a godet roller or the like.

The production method of the liquid crystal polyester fiber of the present invention may further comprise a solid phase polymerization process in which the as-spun yarn obtained by the melt-spinning is heat-treated. Since the as-spun yarn of the liquid crystal polyester fiber of the present invention can accelerate reaction in solid phase polymerization by a catalytic action of a specific metallic element, heat treatment in the solid phase polymerization process can be carried out at a low temperature for a short time.

From the viewpoint of the acceleration of polymerization reaction in solid phase polymerization, the as-spun yarn to be subjected to the solid phase polymerization process may have a total amount of carboxy end groups (total CEG amount) of 5.0 mEq/kg or less, preferably 4.0 mEq/kg or less, more preferably 3.0 mEq/kg or less, further preferably 2.5 mEq/kg or less, and still more preferably 2.0 mEq/kg or less. In the above-mentioned melt-spinning process, the metallic element in the resin composition which is heated and melted (melt-heated) at a temperature of the melting point ($Mp_0$) of liquid crystal polyester or higher may act as a catalyst for decarboxylation reaction, the amount of the carboxy groups at molecular terminals can be decreased by generating elimination of carbon dioxide from carboxy groups at molecular terminals of the liquid crystal polyester.

The method of the heat treatment in the solid phase polymerization process is not particularly limited, and may be any heat treatment, for example, heat treatment by batch process or continuous heat treatment while being conveyed.

For example, the heat treatment by the batch process may be, for example, carried out in a state where as-spun yarns are wound onto a bobbin in the form of a package, or in a state of hank as well as tow. The heat treatment may be preferably carried out in a package because it can be carried out in simpler equipment and improved productivity. The bobbin needs to be endurable to a temperature of solid phase polymerization, and may be preferably from a metal, such as aluminum, brass, iron, and stainless steel.

In the case of the continuous heat treatment while being conveyed, the conveyance method may be carried out by either contact conveyance (for example, a conveyor type, a support roll type, a heated roller type), or non-contact conveyance (a roll-to-roll type). The processing course may be linear or non-linear, and may be arranged using a folding roller and/or a guide to suitably change a length, an angle, a curvature of processing course, etc.

A publicly known method can be used for the solid phase polymerization process, for example, atmosphere heating and contact heating, and other heating procedure. Preferable atmosphere may include an atmosphere such as air, inactive gas (for example, nitrogen, argon), or a combined air thereof. In addition, there is no problem even if the solid phase polymerization process is carried out under vacuum.

In the solid phase polymerization process, a heat treatment temperature may be 230° C. or more, preferably 240° C. or more, and more preferably 250° C. or more from the viewpoint of efficient strength improvement. In order to prevent heat-treated fibers from being fused during heat treatment, the heat treatment temperature may be less than a temperature of a melting point (Mp) of the as-spun yarn to be subjected to the solid phase polymerization process. For example, the heat treatment temperature may be, in the range of 230° C. or more, Mp—80° C. or higher and lower than Mp° C., preferably Mp—50° C. or higher and lower than Mp° C., and more preferably Mp—30° C. or higher and lower than Mp° C. According to the present invention, heat treatment temperature at a low temperature enables to give excellent mechanical properties of liquid crystal polyester fibers. Since liquid crystal polyester fibers enable to enhance their melting points with progress of solid phase polymerization, it is sufficient to carry out the solid phase polymerization process at a first heat treatment temperature of less than the melting point (Mp) of the as-spun yarn. From the viewpoint of efficient strength improvement, heat treatment temperature may be step-wisely raised in accordance with progress of solid phase polymerization, so that the heat treatment may be carried out at a temperature beyond the melting point (melting point of as-spun yarn) at the time of starting the solid phase polymerization process.

According to the present invention, a heat treatment temperature for a short time enables to give excellent mechanical properties of liquid crystal polyester fibers. Depending on heat a treatment procedure and/or heat treatment temperature, a heat treatment period of the solid phase polymerization process may be suitably determined. Although the heat treatment period is not particularly limited as long as desired mechanical properties can be exhibited, the heat treatment period may be determined, for example, from the range of 15 minutes to 15 hours, preferably from 30 minutes to 10 hours, and more preferably from 1 to 8 hours. The short heat treatment period may be, for example, 15 minutes to 3 hours. Here, heat treatment period indicates a retention time at a predetermined heat treatment temperature.

According to the production method of the liquid crystal polyester fiber of the present invention, a strength ratio before and after the solid phase polymerization process of a liquid crystal polyester fiber may be 1.5 times or more, preferably 1.8 times or more, and more preferably 2.0 times or more. Although the higher limit of the strength ratio before and after the solid phase polymerization process of the liquid crystal polyester fiber is not particularly limited, and the strength ratio before and after the solid phase polymerization process may be, for example, 10 times or less. Here, the strength ratio before and after the solid phase polymerization process of the liquid crystal polyester fiber is a value obtained by dividing a tensile strength of a liquid crystal polyester fiber after the solid phase polymerization process by a tensile strength of a liquid crystal polyester fiber before the solid phase polymerization process.

In the production method of the liquid crystal polyester fiber of the present invention, for example, in order to improve gathering property of fibers and to prevent fibers from fuse in the heat treatment, publicly known oil agent may be given before and/or after the solid phase polymerization process. The compound which contains an alkaline metal and an alkaline-earth metal as described above may be provided.

The liquid crystal polyester fiber of the present invention can be advantageously applicable for various fiber structures. Examples of the fiber structures may include products processed at high order, for example, one-dimensional structures such as ropes and commingled yarns, two-dimensional structures such as woven, knitted, and nonwoven fabrics, as well as other various fiber products including tension members (electric wires, optical fibers, heater wire core yarns, cords for various electrical products such as earphone cords, etc.), sailcloth, ropes, sling belts, tails, land nets, life lines, fishing lines, fishing nets, and longlines. The fiber structure may comprise a liquid crystal polyester fiber singly, or may contain other materials to the context in which effect of the present invention is not prevented.

EXAMPLES

Hereinafter, the present invention will be demonstrated by way of some examples that are presented only for the sake of illustration, which are not to be construed as limiting the scope of the present invention. It should be noted that in the following Examples and Comparative Examples, various properties were evaluated in the following manners.

Total Fineness and Single Fiber Fineness

In accordance with JIS L 1013: 2010 8.3.1 A method, liquid crystal polyester fibers were reeled into a hank (100 m in total) with 100 rounds each of which had 1 meter using a sizing reel "Wrap Reel by Motor Driven" produced by DAIEI KAGAKU SEIKI MFG. Co., Ltd., to measure a weight of the liquid crystal polyester fibers. The measurement was conducted in duplicate. Each of the weights (g) was multiplied by 100, and the average value was used as a total fineness (dtex) of the liquid crystal polyester fibers. Thus-obtained total fineness was divided by the number of filaments in the liquid crystal polyester fibers so as to give a single-fiber fineness (dtex).

Melting Point of Fibers and Resin Chips (Granular Objects)

In accordance with JIS K 7121 test method, a melting point (° C.) was determined as a main endothermic peak temperature observed in measurement using a differential scanning calorimeter (DSC; "TA3000" produced by Mettler-Toledo International Inc.). Specifically, a melting point was determined as an endothermic peak from a liquid crystal polyester that occurred when a sample (10 to 20 mg) introduced to an aluminum pan in the DSC device was subjected to a temperature increase at an elevation rate of 20° C./min from 25° C. with supplying nitrogen as a carrier gas at a flow rate of 100 mL/min.

Melting Point of Metallic Compound

A melting point of a metallic compound was measured using the same device and pan as those used in melting point measurement of the fibers. However, in order to remove peaks from hydrated water or a residual solvent, nitrogen was supplied as a carrier gas at a flow rate of 100 mL/min, and a sample in the DSC device was subjected to a temperature increase at an elevation rate of 20° C./min from 25° C. to 150° C. After maintaining the temperature for 1 minute, the sample was cooled at a cooling rate of −20° C./min to 25° C., and then was elevated at 20° C./min from 25° C. to measure the endothermic peak which appears at the lowest temperature.

Content of Metallic Element

In accordance with a procedure described in "microwave digestion" as indicated below, analysis liquid was produced and metallic-elements content (ppm by weight) was calculated by performing ICP-MS measurement.

Microwave Digestion

Microwave digestion was performed using a microwave digestion device "ETHOS-1" produced by Milestone General K. K. Each of the liquid crystal polyester fiber samples (0.1 g) was weighed and inserted to a quartz insert, and then 6 mL of nitric acid (1.42 mol/L) was added. The quartz insert was put into a digestion container containing 5 mL of water and 2 mL of hydrogen peroxide (concentration: 30 wt % to 36 wt %) and sealed, and then microwave digestion was performed. After leaving it to be cooled, the resultant was volumed up to 50 mL and filtered through a filter (pore size: 0.45 μm), and the filtrated object was subjected to ICP-MS measurement.

ICP-MS Measurement

The metallic-elements content in each of the sample liquid produced in the above-mentioned microwave digestion was analyzed using an ICP-MS analysis device "Agirent7900" produced by Agilent Technologies, Inc. Three lots obtained from the same sample liquid were measured under a carrier gas flow rate of 0.7 L/min at an RF output of 1500 W in comparison with XSTC-622 (standard solution produced by SPEX CertiPrep), and the content of each metallic element was determined from the average value.

In a sample such as fibers to which an oil agent was adhered, where the oil agent might contain some metallic elements to affect the measurement, the microwave digestion may be carried out after removing the oil agent by the following methods.

Removal of Oil Agent

Into an aqueous solution in which 2 g of nonionic surfactant (available from Matsumoto Yushi-Seiyaku Co., Ltd., "actinol F-9") was dissolved in 1 L of ion exchange water, was added a liquid crystal polyester fiber sample in an amount of 100 g or less, followed by temperature control in a range of 60 to 90° C., and then the resultant mixture was shaken for 40 minutes. Thereafter the liquid crystal polyester fiber sample was taken out from the aqueous solution, and rinsed two times at each time for 40 minutes with 1 L of ion exchange water with a controlled temperature in a range of 60 to 90° C. The liquid crystal polyester fiber sample was taken out and dried at 80° C. under air atmosphere for 3 hours or longer using a hot air dryer "DN63HI" produced by Yamato Scientific Co., Ltd. so as to obtain a liquid crystal polyester fiber sample from which an oil agent was removed, Tensile Tenacity With reference to JIS L 1013: 2010 8.5.1, using an autograph "AGS-100B" produced by Shimadzu Corporation, tensile test was carried out in a condition of a test sample length of 10 cm and an extension speed of 10 cm/min 6 times per sample yarn to obtain an average tensile strength (cN), and a tensile tenacity (cN/dtex) was calculated by dividing the total fineness (dtex) measured by the above-described method.

Total Amount of CEG(s)

Each of liquid crystal polyester fiber samples was subjected to freeze-grinding until having a particle size of d90=100 μm or less, then to the ground sample was added an excess amount of n-propylamine, followed by heating under agitation at 40° C. for 90 minutes to decompose the sample. In this process, the ester bonds present inside the polymer chain are decomposed into carboxylic acid n-propyl amide and hydroxy groups, while the carboxy end groups (CEG) and hydroxy end groups in the polymer chain are unchanged from the carboxy groups and hydroxy groups. The decomposition products were separated by HPLC method, and peak areas of the separated decomposition products with carboxy groups were compared with calibration curves prepared by HPLC analysis of the respective standard samples so as to quantify the amount (mEq/kg) of the carboxy end groups derived from each of the monomers. For example, the amount of CEG derived from monovalent carboxylic acids such as 4-hydroxybenzoic acid and 6-hydroxy-2-naphthoic acid can be directly determined as the amount of 4-hydroxybenzoic acid and 6-hydroxy-2-naphthoic acid. The amount of CEG derived from divalent carboxylic acids such as terephthalic acid, isophthalic acid, and 2,6-naphthalene dicarboxylic acid can be determined by quantifying the amount of amidation products in which one of two carboxy groups is amidized, such as terephthalic acid mono-n-propyl amide, isophthalic acid mono-n-propyl amide, or 2,6-naphthalene dicarboxylic acid mono-n-propyl amide. The sum of all the amounts of carboxy end groups contained in each sample was taken as the total carboxy end group amount (total CEG amount) (mEq/kg) of the sample.

Total Amount of One-End Groups

In the same way as the measurement of the above-mentioned total amount of CEG(s), each of the liquid crystal polyester fiber samples was decomposed with n-propylamine to determine the total amount of end groups (mEq/kg) of both carboxy end groups derived from hydroxycarboxylic acids and one-end groups generated by decarboxylation reaction of carboxy groups derived from hydroxycarboxylic acids. For example, the amount of end groups derived from 4-hydroxybenzoic acid can be calculated by quantifying 4-hydroxybenzoic acid and phenol; the amount of end groups derived from 6-hydroxy-2-naphthoic acid can be calculated by quantifying 6-hydroxy-2-naphthoic acid and 2-naphthol. In order to take into consideration the amounts of end groups other than hydroxycarboxylic acids, such as end groups derived from diols and dicarboxylic acids, the total amount of end groups derived from hydroxycarboxylic acids was divided by a molar ratio of structural units derived from hydroxycarboxylic acids in the liquid crystal polyester of the sample, and thus obtained value was regarded as a total amount of one-end groups of the sample.

Ketone Bond Amount

Ketone bond amount was calculated by the pyrolysis-gas chromatography method described in Polymer Degradation and Stability, 76, 85-94 (2002). Specifically, each of the liquid crystal polyester fiber samples was heated using a thermal decomposition device ("PY2020iD" produced by Frontier Laboratories Ltd.) in the presence of tetramethylammonium hydroxide (TMAH) so as to generate a gas by pyrolysis/methylation. The generated gas was analyzed using a gas chromatography ("GC-6890N" produced by Agilent Technologies, Inc.), and the ketone bond amount (mol %) was calculated from a peak area from ketone bonds and a peak area from ester bonds.

Heat Aging Resistance

After twisting sample fibers at 80 T/m in the Z direction, the twisted fibers were reeled into a hank (50 m in total) with 50 rounds each of which had 1 meter using a sizing reel "Wrap Reel by Motor Driven" produced by DAIEI KAGAKU SEIKI MFG. Co., Ltd. The reeled fibers were heated at 250° C. under air atmosphere using a hot air dryer "DN63HI" produced by Yamato Scientific Co., Ltd. Two hanks were produced per sample, one hank was heated for 100 hours, and the other hank was heated for 300 hours. At the time of heating, each of the hanks was hung on a metal rod which passed between opposed ends in an upper position of the dryer so that the hank was placed in a position without contact other than contact points to the metal rod. The heated sample portions other than the contact points to the metal rod were measured in the above-mentioned method so as to give an average tensile strength (cN). The tenacity retention percentages (%) at 250° C. for 100 hours and 300 hours were calculated by dividing the tensile strength value by an average tensile strength (cN) before heating, and then multiplied by 100.

Example 1

To chips (granular molded bodies) of a liquid crystal polyester resin (a) ($Mp_0$: 281° C.) in which the structural units (A) and (B) as shown in the following formulae had a ratio (A)/(B)=73/27 (molar ratio) and the total content of alkali metal and alkaline earth metal was 10 ppm by weight or less, was added copper(I) acetate powder (available from FUJIFILM Wako Chemical Corporation, melting point: 271° C.) as a polymerization catalyst at a proportion of 50 ppm by weight in terms of copper atoms (a content of copper element relative to a total amount of the resin chip and the polymerization catalyst), and mixed sufficiently using a shaking device. Thus-obtained blend of the resin chips and the polymerization catalyst was dried under hot air at 120° C. for at least 4 hours, and subjected to a twin-screw extruder (CD 15 mm) ("KZW15TW-45MG-NH (−700)" produced by TECHNOVEL CORPORATION) to be melt-extruded at a heater temperature of 300° C. to be fed to a spinning head with being metered by a gear pump. In this process, a vacuum pump (dry pump "KRF40A-V-01B" produced by ORION MACHINERY CO., LTD.) was connected via a metal pipe to a vent portion which was provided in the middle of the twin-screw extruder to reduce the pressure in the space not filled with the resin composition in the twin-screw extruder into 60 kPa. The temperature in a range from the extruder outlet to the spinning head was set at 310° C. The spinning head was equipped with a spinneret with 50 holes, each of the holes having a hole diameter of 0.125 mm+ and a land length of 0.175 mm, and the resin composition was discharged at a discharge rate of 28 g/min to obtain as-spun yarns of liquid crystal polyester by winding at a winding rate of 1000 m/min. At this time, a 2 wt % aqueous solution of sodium dodecyl phosphate (available from FUJIFILM Wako Pure Chemical Corporation, Wako first grade) was applied to the as-spun yarns through an oiling guide placed directly below the spinneret. The amount of the aqueous solution applied was 1.4 g/min, and the adhesion proportion of sodium dodecyl phosphate to the as-spun yarns was 0.1 wt % as a calculation value.

Chem. 8

(A)

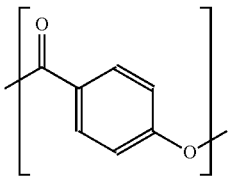

(B)

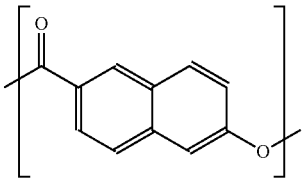

Next, 4 kg of the as-spun yarns obtained in the above process was rewound onto an aluminum bobbin at a winding density of 0.6 g/cm$^3$, and subjected to a heating process under a nitrogen atmosphere using a closed oven at temperatures raised from 25° C. to 250° C. in 2 hours, heat-treated at 250° C. for 3 hours, and lowered from 250° C. to 25° C. in 2 hours to obtain heat-treated liquid crystal polyester filament yarns. The analysis results of the obtained liquid crystal polyester fibers (as-spun yarn and heat-treated yarn) are shown in Table 5.

Example 2

To 5 L of acetonitrile (available from FUJIFILM Wako Pure Chemical Corporation, special grade reagent), were added two kinds of reagents, copper(I) iodide (available from FUJIFILM Wako Pure Chemical Corporation, special grade reagent) at an amount of 1 mol and 1,10-phenanthroline (available from FUJIFILM Wako Chemical Corporation) in equal molar amount with copper(I) iodide, stirred in a condition of suspension for 1 hour, filtered, and dried at 100° C. for 3 hours to obtain an orange solid (melting point: 300° C.).

Except that this solid was used as a polymerization catalyst instead of the copper(I) acetate at a proportion of 50 ppm by weight in terms of copper atoms, as-spun yarns and heat-treated fibers of liquid crystal polyester were obtained in the same way as Example 1. The analysis results of the obtained liquid crystal polyester fibers (as-spun yarn and heat-treated yarn) are shown in Table 5.

Example 3

Except that copper(II) acetate (available from FUJIFILM Wako Pure Chemical Corporation, Wako First Grade, melting point: 115° C.) was added to the resin as a polymerization catalyst instead of the copper(I) acetate at a proportion of 50 ppm by weight in terms of copper atoms, as-spun yarns and heat-treated fibers of liquid crystal polyester were obtained in the same way as Example 1. The analysis results of the obtained liquid crystal polyester fibers (as-spun yarn and heat-treated yarn) are shown in Table 5.

Example 4

To 5 L of acetonitrile (available from FUJIFILM Wako Pure Chemical Corporation, special grade reagent), were added two kinds of reagents, copper(II) sulfate pentahydrate (available from FUJIFILM Wako Pure Chemical Corporation, special grade reagent) at an amount of 1 mol and 1,10-phenanthroline (available from FUJIFILM Wako Chemical Corporation) in twice molar amount with copper (II) sulfate pentahydrate, stirred in a condition of suspension for 1 hour, filtered, and dried at 100° C. for 3 hours to obtain a blue solid (melting point: 294° C.).

Except that this solid was used as a polymerization catalyst instead of the copper(I) acetate at a proportion of 50 ppm by weight in terms of copper atoms, as-spun yarns and heat-treated fibers of liquid crystal polyester were obtained in the same way as Example 1. The analysis results of the obtained liquid crystal polyester fibers (as-spun yarn and heat-treated yarn) are shown in Table 5.

Example 5

Except that cobalt(II) acetate tetrahydrate (available from FUJIFILM Wako Pure Chemical Corporation, Wako special grade, melting point: 194° C.) was used as a polymerization catalyst instead of the copper(I) acetate at a proportion of 50 ppm by weight in terms of cobalt atoms, as-spun yarns and heat-treated fibers of liquid crystal polyester were obtained in the same way as Example 1. The analysis results of the obtained liquid crystal polyester fibers (as-spun yarn and heat-treated yarn) are shown in Table 5.

Example 6

Except that palladium(II) acetate (available from FUJIFILM Wako Pure Chemical Corporation, Wako special grade, melting point: 205° C.) was used as a polymerization catalyst instead of the copper(I) acetate at a proportion of 50 ppm by weight in terms of palladium atoms, as-spun yarns and heat-treated fibers of liquid crystal polyester were obtained in the same way as Example 1. The analysis results of the obtained liquid crystal polyester fibers (as-spun yarn and heat-treated yarn) are shown in Table 5.

Example 7

Except that a proportion of copper(I) acetate added to the resin was changed into 5 ppm by weight in terms of copper atoms, as-spun yarns and heat-treated fibers of liquid crystal polyester were obtained in the same way as Example 1. The analysis results of the obtained liquid crystal polyester fibers (as-spun yarn and heat-treated yarn) are shown in Table 5.

Example 8

Except that a proportion of copper(I) acetate added to the resin was changed into 500 ppm by weight in terms of copper atoms, as-spun yarns and heat-treated fibers of liquid crystal polyester were obtained in the same way as Example 1. The analysis results of the obtained liquid crystal polyester fibers (as-spun yarn and heat-treated yarn) are shown in Table 5.

Example 9

To the chip (granular molded bodies) of the liquid crystal polyester resin (a) described in Example 1, was added copper(I) acetate powder (available from FUJIFILM Wako Pure Chemical Corporation, melting point: 271° C.) as a polymerization catalyst at a proportion of 500 ppm by weight in terms of copper atoms, and mixed sufficiently using a shaking device. Thus-obtained blend of the resin chips and the polymerization catalyst was dried under hot air at 120° C. for at least 4 hours, and subjected to a twin-screw extruder (Φ 15 mm) ("KZW15TW-45MG-NH (−700)" produced by TECHNOVEL CORPORATION) to be melt-extruded at a heater temperature of 300° C. to be fed to a die tip with being metered by a gear pump. In this process, a vacuum pump (dry pump "KRF40A-V-01B" produced by ORION MACHINERY CO., LTD.) was connected via a metal pipe to a vent portion which was provided in the middle of the twin-screw extruder to reduce the pressure in the space not filled with the resin composition in the twin-screw extruder into 60 kPa. The temperature in a range from the extruder outlet to the die tip was set at 310° C. At the die tip, the resin was discharged from a 3 mm$ circular hole at a discharge rate of 28 g/min in the form of a rod. While taking up a rod-shaped resin composition at a take-up speed of 5 m/min, the rod-shaped resin composition was cut using a rotary cutter to a length diameter of 5 mm or less to obtain resin composition chips. Thus-obtained resin composition chips (mixed with 500 ppm by weight of copper element) and the chips of the liquid crystal polyester resin (a) were blended at a weight ratio of 1:9, and well-mixed using a shaking device, and dried under hot air at 120° C. for at least 4 hours. The blend mixture of two species of chips was subjected to a twin-screw extruder ((<15 mm) ("KZW15TW-45MG-NH (−700)" produced by TECHNOVEL CORPORATION) to be melt-extruded at a heater temperature of 300° C. to be fed to a spinning head with being metered by a gear pump. In this process, a vacuum pump (dry pump "KRF40A-V-01B" produced by ORION MACHINERY CO., LTD.) was connected via a metal pipe to a vent portion which was provided in the middle of the twin-screw extruder to reduce the pressure in the space not filled with the resin composition in the twin-screw extruder into 60 kPa. The temperature in a range from the extruder outlet to the spinning head was set at 310° C. The spinning head was equipped with a spinneret with 50 holes, each of the holes having a hole diameter of 0.125 mm #and a land length of 0.175 mm, and the resin composition was discharged at a discharge rate of 28 g/min to obtain as-spun yarns of liquid crystal polyester fibers by winding at a winding rate of 1000 m/min. At this time, a 2 wt % aqueous solution of sodium dodecyl phosphate (available from FUJIFILM Wako Pure Chemical Corporation, Wako first grade) was applied to the as-spun yarn through an oiling guide placed directly below the spinneret. The amount of the aqueous solution applied was 1.4 g/min, and the adhesion proportion of sodium dodecyl phosphate to the as-spun yarns was 0.1 wt % as a calculation value.

Next, 4 kg of the as-spun yarns obtained in the above process was rewound onto an aluminum bobbin at a winding density of 0.6 g/cm$^3$, and subjected to a heating process under a nitrogen atmosphere using a closed oven at temperatures raised from 25° C. to 250° C. in 2 hours, heat-treated at 250° C. for 3 hours, and lowered from 250° C. to 25° C. in 2 hours to obtain heat-treated liquid crystal polyester filament yarns. The analysis results of the obtained liquid crystal polyester fibers (as-spun yarn and heat-treated yarn) are shown in Table 5.

Example 10

Except for using the spinning head equipped with a spinneret with 100 holes, each of the holes having a hole diameter of 0.100 mmϕ and a land length of 0.140 mm, as-spun yarns were obtained in the same way as Example 1. Then, the as-spun yarns were heat-treated in the same way as Example 1 to obtain heat-treated fibers. The analysis results of the obtained liquid crystal polyester fibers (as-spun yarn and heat-treated yarn) are shown in Table 5.

Example 11

Except for using the spinning head equipped with a spinneret with 20 holes, each of the holes having a hole diameter of 0.150 mmϕ and a land length of 0.210 mm as-spun yarns were obtained in the same way as Example 1. Then, the as-spun yarns were heat-treated in the same way as Example 1 to obtain heat-treated fibers. The analysis results of the obtained liquid crystal polyester fibers (as-spun yarn and heat-treated yarn) are shown in Table 5.

Example 12

Except that the spinning head equipped with a spinneret with 20 holes, each of the holes having a hole diameter of 0.125 mmϕ and a land length of 0.175 mm was used; that the resin composition was discharged at a discharging rate of 11.0 g/min; and that the amount of the aqueous solution of sodium dodecyl phosphate applied from the oiling guide was 0.55 g/min; as-spun yarns were obtained in the same way as Example 1. Then, the as-spun yarns were heat-treated in the same way as Example 1 to obtain heat-treated fibers. The analysis results of the obtained liquid crystal polyester fibers (as-spun yarn and heat-treated yarn) are shown in Table 5.

Example 13

Except that a liquid crystal polyester resin (β) ($Mp_0$: 348° C.) with a molar ratio of (A)/(C)/(D)/(E)=65/10/5/20 for each structural unit as shown in the following formulae with a total content of alkali metals and alkaline earth metals of 10 ppm by weight or lower was used instead of the liquid crystal polyester resin (α) described in Example 1; that the heater temperature of the extruder during melt extrusion was 360° C.; and that the temperature in a range from the extruder outlet to the spinning head was changed into 360° C.; as-spun yarns were obtained in the same way as Example 1. Then, the heat-treated fibers were obtained in the same way as Example 1 except for changing the heat treatment temperature of the as-spun yarns into 290° C. in a closed oven. The analysis results of the obtained liquid crystal polyester fibers (as-spun yarn and heat-treated yarn) are shown in Table 5.

Chem. 9

(A)

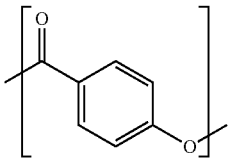

(C)

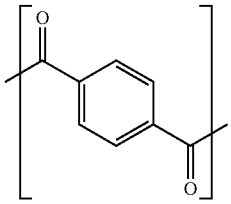

(D)

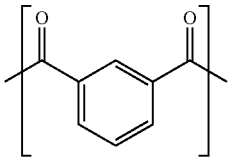

(E)

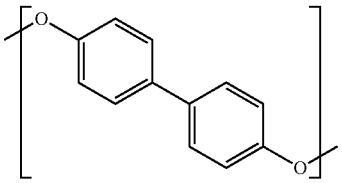

Example 14

Except that a liquid crystal polyester resin (γ) ($Mp_0$: 315° C.) with a molar ratio of (A)/(C)/(D)/(E)/(F)=54/15/8/16/7 for each structural unit as shown in the following formulae with a total content of alkali metals and alkaline earth metals of 10 ppm by weight or lower was used instead of the liquid crystal polyester resin (α) described in Example 1; that the heater temperature of the extruder during melt extrusion was 340° C.; and that the temperature in a range from the extruder outlet to the spinning head was changed into 350° C.; as-spun yarns were obtained in the same way as Example 1. Then, the heat-treated fibers were obtained in the same way as Example 1 except for changing the heat treatment temperature of the as-spun yarns into 260° C. in the closed oven. The analysis results of the obtained liquid crystal polyester fibers (as-spun yarn and heat-treated yarn) are shown in Table 5.

Chem. 10

(A)

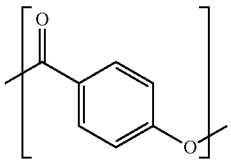

(C)

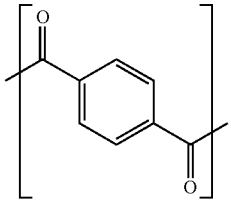

(D)

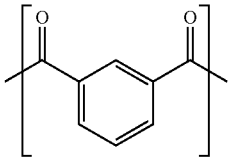

(E)

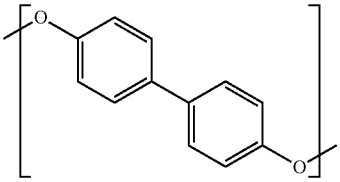

(F)

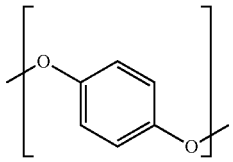

Example 15

Except that a proportion of the orange solid (copper(I) iodide and 1,10-phenanthroline) added to the resin was changed into 10 ppm by weight in terms of copper atoms, as-spun yarns and heat-treated fibers of liquid crystal polyester were obtained in the same way as Example 2. The analysis results of the obtained liquid crystal polyester fibers (as-spun yarn and heat-treated yarn) are shown in Table 5.

Example 16

Except that a proportion of the orange solid (copper(I) iodide and 1,10-phenanthroline) added to the resin was changed into 20 ppm by weight in terms of copper atoms, as-spun yarns and heat-treated fibers of liquid crystal polyester were obtained in the same way as Example 2. The analysis results of the obtained liquid crystal polyester fibers (as-spun yarn and heat-treated yarn) are shown in Table 5.

Example 17

Except that a proportion of the orange solid (copper(I) iodide and 1,10-phenanthroline) added to the resin was changed into 30 ppm by weight in terms of copper atoms, as-spun yarns and heat-treated fibers of liquid crystal polyester were obtained in the same way as Example 2. The analysis results of the obtained liquid crystal polyester fibers (as-spun yarn and heat-treated yarn) are shown in Table 5.

Example 18

Except that a proportion of the orange solid (copper(I) iodide and 1,10-phenanthroline) added to the resin was changed into 70 ppm by weight in terms of copper atoms, as-spun yarns and heat-treated fibers of liquid crystal polyester were obtained in the same way as Example 2. The analysis results of the obtained liquid crystal polyester fibers (as-spun yarn and heat-treated yarn) are shown in Table 5.

Example 19

Except that a proportion of the orange solid (copper(I) iodide and 1,10-phenanthroline) added to the resin was changed into 100 ppm by weight in terms of copper atoms, as-spun yarns and heat-treated fibers of liquid crystal polyester were obtained in the same way as Example 2. The analysis results of the obtained liquid crystal polyester fibers (as-spun yarn and heat-treated yarn) are shown in Table 5.

Example 20

Except that a proportion of the orange solid (copper(I) iodide and 1,10-phenanthroline) added to the resin was changed into 150 ppm by weight in terms of copper atoms, as-spun yarns and heat-treated fibers of liquid crystal polyester were obtained in the same way as Example 2. The analysis results of the obtained liquid crystal polyester fibers (as-spun yarn and heat-treated yarn) are shown in Table 5.

Comparative Example 1

Except that the liquid crystal polyester resin ($\alpha$) chips alone were used as raw material for spinning without the polymerization catalyst, as-spun yarns and heat-treated fibers of liquid crystal polyester were obtained in the same way as in Example 1. The analysis results of the obtained liquid crystal polyester fibers (as-spun yarn and heat-treated yarn) are shown in Table 5.

Comparative Example 2

Except that potassium acetate (available from FUJIFILM Wako Pure Chemical Corporation, special grade reagent) was added to the resin as a polymerization catalyst instead of copper(I) acetate at a proportion of 50 ppm by weight in terms of potassium atoms, as-spun yarns and heat-treated fibers of liquid crystal polyester were obtained in the same way as in Example 1. The analysis results of the obtained liquid crystal polyester fibers (as-spun yarn and heat-treated yarn) are shown in Table 5.

Comparative Example 3

Except that N,N-dimethyl-4-aminopyridine (DMAP) (available from FUJIFILM Wako Pure Chemical Corporation, special grade reagent) was added to the resin at a weight ratio of 1 wt % as a polymerization catalyst instead of copper(I) acetate, as-spun yarns and heat-treated fibers of liquid crystal polyester were obtained in the same way as in Example 1. The analysis results of the obtained liquid crystal polyester fibers (as-spun yarn and heat-treated yarn) are shown in Table 5.

Comparative Example 4

Except that potassium acetate (available from FUJIFILM Wako Pure Chemical Corporation, special grade reagent) was added to the resin as a polymerization catalyst instead of copper(I) acetate at a proportion of 50 ppm by weight in terms of potassium atoms, as-spun yarns and heat-treated fibers of liquid crystal polyester were obtained in the same way as in Example 13. The analysis results of the obtained liquid crystal polyester fibers (as-spun yarn and heat-treated yarn) are shown in Table 5.

Comparative Example 5

Except that potassium acetate (available from FUJIFILM Wako Pure Chemical Corporation, special grade reagent) was added to the resin as a polymerization catalyst instead of copper(I) acetate at a proportion of 50 ppm by weight in terms of potassium atoms, as-spun yarns and heat-treated fibers of liquid crystal polyester were obtained in the same way as in Example 14. The analysis results of the obtained liquid crystal polyester fibers (as-spun yarn and heat-treated yarn) are shown in Table 5.

TABLE 5

| | Resin composition | | | | | As-spun yarn analysis | | | | | Heat-treated fiber analysis | | | | | Evaluation | | | | | |
|---|---|---|---|---|---|---|---|---|---|---|---|---|---|---|---|---|---|---|---|---|---|
| | LCP Spec. | Catalyst Spec. | Metal compnd. melting point ° C. | Metal elemnt. Spec. | Metal elemnt. content added wt ppm | Total fineness dtex | Single fiber fineness dtex | Filament No. | Total CEG amt. mEq/kg | Total one-end group amt. mEq/kg | Total fineness dtex | Total one-end group amt. mEq/kg | Ketone bond amt. mol % | Melting point ° C. | Metal elemnt. content wt ppm | Tenacity as-spun yarn cN/dtex | Tenacity heat-treated fiber cN/dtex | Heat aging resistance 100 hr cN/dtex | Heat aging resistance 100 hr % | Heat aging resistance 300 hr cN/dtex | Heat aging resistance 300 hr % |
| Ex. 1 | (α) | copper(I) acetate | 271 | Cu | 50 | 280 | 5.6 | 50 | 1.8 | 70.1 | 280 | 11.1 | 0.017 | 322 | 41 | 9.4 | 25.2 | 23.4 | 93 | 17.6 | 70 |
| Ex. 2 | (α) | copper(I) iodide * phenanthroline | 300 | Cu | 50 | 280 | 5.6 | 50 | 2.1 | 71.0 | 280 | 10.2 | 0.017 | 326 | 46 | 9.3 | 26.1 | 22.7 | 87 | 17.7 | 68 |
| Ex. 3 | (α) | copper(II) acetate | 115 | Cu | 50 | 280 | 5.6 | 50 | 2.1 | 65.3 | 280 | 10.1 | 0.018 | 326 | 43 | 9.5 | 26.2 | 23.3 | 89 | 18.3 | 70 |
| Ex. 4 | (α) | copper(II) sulfate * $(phenanthroline)_2$ | 294 | Cu | 50 | 280 | 5.6 | 50 | 1.8 | 65.1 | 280 | 9.9 | 0.017 | 325 | 44 | 9.4 | 25.9 | 22.8 | 88 | 17.6 | 68 |
| Ex. 5 | (α) | cobalt(II) acetate tetrahydrate | 194 | Co | 50 | 280 | 5.6 | 50 | 3.4 | 71.4 | 280 | 11.5 | 0.016 | 321 | 45 | 9.5 | 23.5 | 20.4 | 87 | 15.7 | 67 |
| Ex. 6 | (α) | palladium(II) acetate | 205 | Pd | 50 | 280 | 5.6 | 50 | 4.9 | 72.0 | 280 | 9.2 | 0.019 | 325 | 44 | 9.2 | 26.9 | 23.7 | 88 | 18.8 | 70 |
| Ex. 7 | (α) | copper(I) acetate | 271 | Cu | 5 | 280 | 5.6 | 50 | 4.9 | 72.1 | 280 | 11.8 | 0.018 | 320 | 3 | 9.5 | 24.4 | 22.4 | 92 | 17.8 | 73 |
| Ex. 8 | (α) | copper(I) acetate | 271 | Cu | 500 | 280 | 5.6 | 50 | 1.7 | 65.1 | 280 | 9.1 | 0.025 | 322 | 420 | 9.2 | 26.0 | 22.6 | 87 | 16.9 | 65 |
| Ex. 9 | (α) | copper(I) acetate | 271 | Cu | 50 | 280 | 5.6 | 50 | 1.6 | 66.7 | 280 | 11.0 | 0.016 | 322 | 45 | 9.4 | 25.3 | 23.0 | 91 | 17.2 | 68 |
| Ex. 10 | (α) | copper(I) acetate | 271 | Cu | 50 | 280 | 2.8 | 100 | 2.2 | 66.7 | 280 | 11.1 | 0.017 | 324 | 44 | 9.3 | 25.2 | 22.7 | 90 | 18.1 | 72 |
| Ex. 11 | (α) | copper(I) acetate | 271 | Cu | 50 | 280 | 14 | 20 | 2.3 | 71.3 | 280 | 11.9 | 0.018 | 323 | 41 | 9.3 | 23.9 | 21.3 | 89 | 16.7 | 70 |
| Ex. 12 | (α) | copper(I) acetate | 271 | Cu | 50 | 110 | 5.6 | 20 | 1.8 | 66.6 | 110 | 10.4 | 0.018 | 322 | 42 | 9.6 | 25.7 | 23.4 | 91 | 17.7 | 69 |
| Ex. 13 | (β) | copper(I) acetate | 271 | Cu | 50 | 280 | 5.6 | 50 | 1.8 | 95.4 | 280 | 10.0 | 0.032 | 343 | 45 | 6.9 | 25.6 | 24.1 | 94 | 19.5 | 76 |
| Ex. 14 | (γ) | copper(I) acetate | 271 | Cu | 50 | 280 | 5.6 | 50 | 2.0 | 93.1 | 280 | 9.9 | 0.037 | 348 | 46 | 8.0 | 23.6 | 21.7 | 92 | 17.2 | 73 |
| Ex. 15 | (α) | copper(I) iodide * phenanthroline | 300 | Cu | 10 | 280 | 5.6 | 50 | 2.3 | 71.8 | 280 | 9.7 | 0.018 | 325 | 9 | 9.4 | 25.4 | 22.4 | 88 | 17.0 | 67 |
| Ex. 16 | (α) | copper(I) iodide * phenanthroline | 300 | Cu | 20 | 280 | 5.6 | 50 | 1.9 | 72.1 | 280 | 10.0 | 0.020 | 323 | 19 | 9.4 | 25.8 | 22.4 | 87 | 18.1 | 70 |
| Ex. 17 | (α) | copper(I) iodide * phenanthroline | 300 | Cu | 30 | 280 | 5.6 | 50 | 1.9 | 67.2 | 280 | 9.8 | 0.020 | 328 | 30 | 9.3 | 26.1 | 23.0 | 88 | 18.0 | 69 |
| Ex. 18 | (α) | copper(I) iodide * phenanthroline | 300 | Cu | 70 | 280 | 5.6 | 50 | 1.8 | 66.8 | 280 | 10.1 | 0.016 | 325 | 64 | 9.3 | 25.8 | 23.2 | 90 | 17.5 | 68 |
| Ex. 19 | (α) | copper(I) iodide * phenanthroline | 300 | Cu | 100 | 280 | 5.6 | 50 | 1.8 | 66.7 | 280 | 11.8 | 0.017 | 327 | 98 | 9.3 | 23.4 | 21.1 | 90 | 16.6 | 71 |
| Ex. 20 | (α) | copper(I) iodide * phenanthroline | 300 | Cu | 150 | 280 | 5.6 | 50 | 1.7 | 61.3 | 280 | 12.5 | 0.025 | 329 | 144 | 9.1 | 22.1 | 20.3 | 92 | 16.6 | 75 |
| Com. Ex. 1 | (α) | — | — | — | — | 280 | 5.6 | 50 | 9.0 | 71.0 | 280 | 17.2 | 0.017 | 320 | — | 9.2 | 15.8 | 21.0 | 133 | 17.1 | 108 |
| Com. Ex. 2 | (α) | potassium acetate | 292 | K | 50 | 280 | 5.6 | 50 | 8.9 | 71.3 | 280 | 12.2 | 0.018 | 326 | 41 | 9.6 | 23.4 | 15.2 | 65 | 9.4 | 40 |
| Com Ex. 3 | (α) | DMAP | — | — | a) | 280 | 5.6 | 50 | 9.1 | 71.4 | 280 | 16.9 | 0.018 | 321 | — | 9.1 | 15.1 | 18.6 | 123 | 16.6 | 110 |
| Com. Ex. 4 | (β) | potassium acetate | 292 | K | 50 | 280 | 5.6 | 50 | 21.8 | 95.2 | 280 | 9.3 | 0.033 | 345 | 40 | 7.1 | 22.8 | 13.7 | 60 | 9.3 | 41 |
| Com. Ex. 5 | (γ) | potassium acetate | 292 | K | 50 | 280 | 5.6 | 50 | 18.7 | 92.5 | 280 | 8.9 | 0.035 | 343 | 43 | 8.4 | 23.0 | 14.0 | 61 | 8.5 | 37 |

a) DMAP is a catalyst without metal. Content of DMAP itself is 1 wt %.

As shown in Table 5, since the as-spun yarns of Examples 1-20 contain specific metallic elements, catalytic action of these elements makes it possible to obtain heat-treated fibers with high intensities by the heat treatment at a low temperature for a short time. Further, the specific metallic elements used in Examples 1-20 enable selective progress of reactions in solid phase polymerization while suppressing side reactions which bring about tenacity reduction, so as to obtain heat-treated fibers excellent in heat aging resistance.

On the other hand, the as-spun yarns of Comparative Example 1 without a catalyst incapable of progressing sufficient solid phase polymerization at the low temperature for the short time fail to obtain the heat-treated fiber with high tenacity. In the meantime, the heat aging resistance test advances solid phase polymerization of the as-spun yarns so as to enhance the tenacity.

The as-spun yarns of Comparative Example 3 contain the organic catalyst as the polymerization catalyst to synthesize liquid crystal polyester. However, as in Comparative Example 1 without a catalyst, Comparative Example 3 fails to achieve sufficient solid phase polymerization progress at the low temperature and short time heat treatment, probably due to thermal degradation during melt spinning, resulting in failing to obtain heat-treated fibers with high tenacity. In the meantime, the heat aging resistance test advances solid phase polymerization of the as-spun yarns so as to enhance the tenacity.

In Comparative Examples 2, 4, and 5, although heat-treated fibers have high tenacity by heat treatment at the low temperatures for the short periods, alkali metals contained in these fibers cause not only the reaction in solid phase polymerization but also proceed side reactions, so that heat aging resistance test shows a marked decrease in strength compared to the heat-treated yarns in Examples 1 to 20.

INDUSTRIAL APPLICABILITY

The liquid crystal polyester fiber of the present invention can be used as various textiles, such as a rope, a network, a fishing net, a sling belt, and a tension member.

Preferred embodiments of the present invention are shown and described. It is to be understood that various changes, modifications and omissions may be made without departing from the spirit of the present invention and are encompassed in the scope of the claims.

What is claimed is:

1. A heat-treated liquid crystal polyester fiber, comprising:

at least one metallic element selected from the group consisting of metallic elements from Group 8 to Group 11 in Periodic Table, wherein the heat-treated liquid crystal polyester fiber has a tenacity of 18 cN/dtex or higher.

2. The heat-treated liquid crystal polyester fiber according to claim 1, wherein a total content of the at least one metallic element in the heat-treated liquid crystal polyester fiber is from 1 to 1000 ppm by weight.

3. The heat-treated liquid crystal polyester fiber according to claim 1, wherein the at least one metallic element is contained in the heat-treated liquid crystal polyester fiber as at least one metallic compound each having a melting point of $(Mp_0+30)$° C. or lower, the where $Mp_0$ denotes a melting point of a liquid crystal polyester constituting the heat-treated liquid crystal polyester fiber.

4. The heat-treated liquid crystal polyester fiber according to claim 1, wherein a liquid crystal polyester constituting the heat-treated liquid crystal polyester fiber has a total amount of carboxy end groups derived from hydroxycarboxylic acids and one-end groups generated by decarboxylation reaction of carboxy groups derived from hydroxycarboxylic acids, of 20 mEq/kg or less.

5. The heat-treated liquid crystal polyester fiber according to claim 1, wherein a liquid crystal polyester constituting the heat-treated liquid crystal polyester fiber has a ketone bond amount, measured by a pyrolysis-gas chromatography method, of 0.05 mol % or less.

6. The heat-treated liquid crystal polyester fiber according to claim 1, wherein a total content of an alkaline metal and an alkaline-earth metal is 10 ppm by weight or less in the heat-treated liquid crystal polyester fiber.

7. The heat-treated liquid crystal polyester fiber according to claim 1, having a single fiber fineness of 0.5 to 50 dtex.

8. A method to produce the heat-treated liquid crystal polyester fiber according to claim 1, the method comprising:

melt-spinning a resin composition comprising a liquid crystal polyester and the at least one metallic element to obtain an as-spun yarn.

9. The production method according to claim 8, wherein the resin composition contains the at least one metallic element in a total content of from 1 to 1000 ppm by weight.

10. The production method according to claim 8, wherein the at least one metallic element is contained in the resin com position as at least one metallic compound each having a melting point of $(Mp_0+30)$° C. or lower, where the $Mp_0$ denotes a melting point of the liquid crystal polyester.

11. The production method according to claim 8, further comprising:

heat-treating the as-spun yarn.

12. The production method according to claim 11, wherein the as-spun yarn has a total amount of carboxy end groups of 5.0 mEq/kg or less.

13. A fiber structure, at least partially comprising the heat-treated liquid crystal polyester fiber according to claim 1.

14. A liquid crystal polyester fiber, comprising:

at least one metallic element selected from the group consisting of metallic elements from Group 8 to Group 11 in Periodic Table, wherein a total content of the at least one metallic element in the liquid crystal polyester fiber is from 10 to 1000 ppm by weight, a total content of an alkaline metal and an alkaline-earth metal in the liquid crystal polyester fiber is 10 ppm by weight or less, and the liquid crystal polyester fiber has a single fiber fineness of 0.5 to 50 dtex.

15. The heat-treated liquid crystal polyester fiber according to claim 1, wherein a liquid crystal polyester constituting the heat-treated liquid crystal polyester fiber consists of a combination of structural units represented by any one of the following formulae (1) to (16) and (18):

(1)

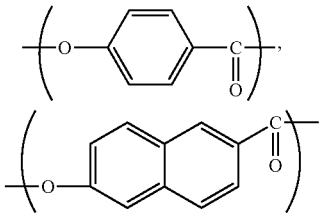

-continued
(2)
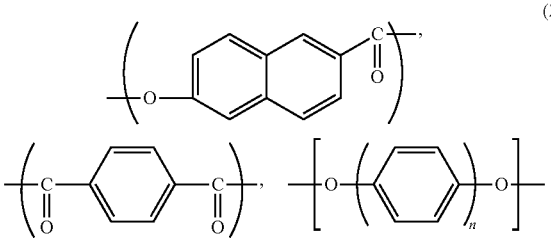
(3)
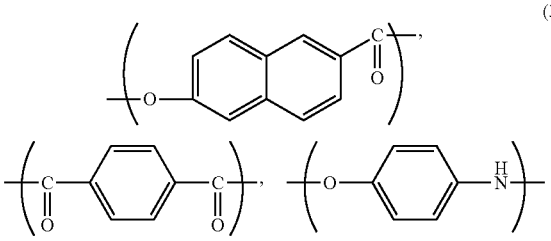
(4)
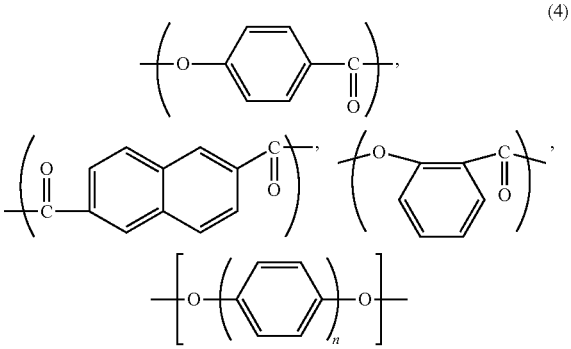
(5)
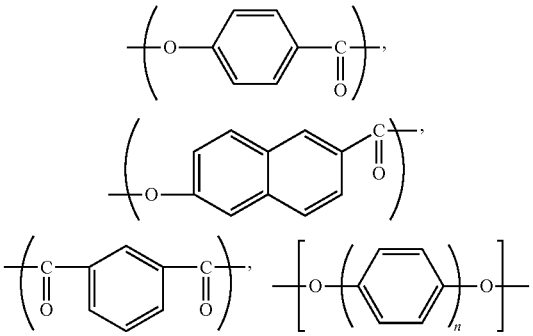
(6)
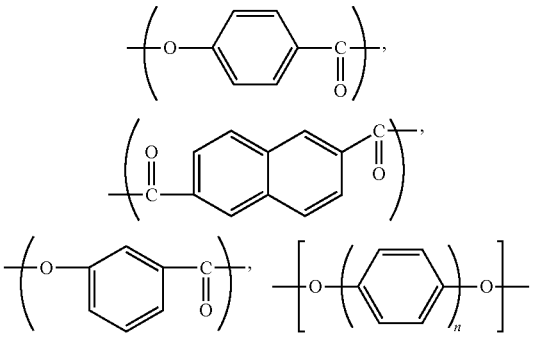
(7)
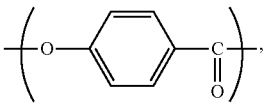
-continued
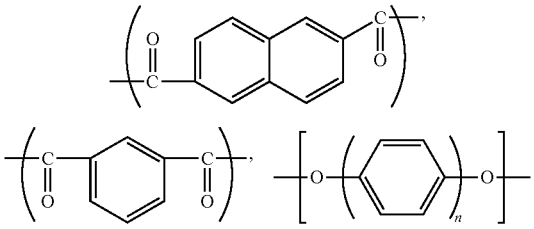
(8)
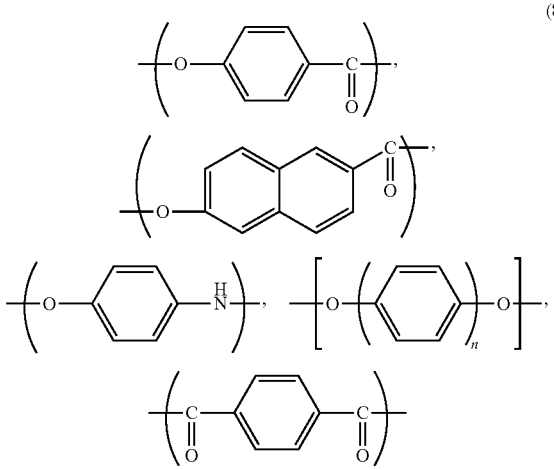
(9)
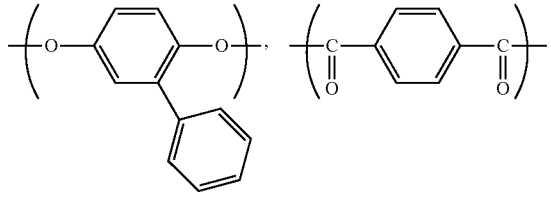
(10)
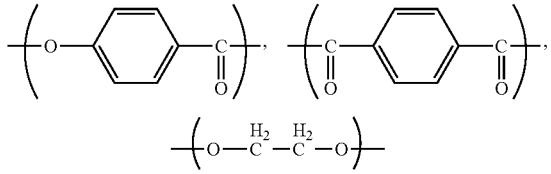
(11)
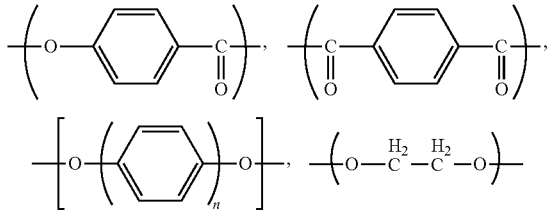
(12)
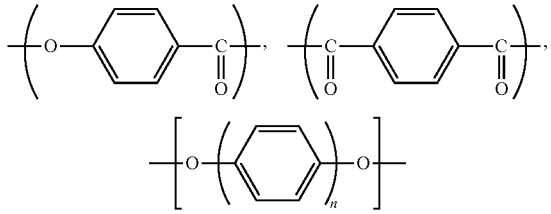

-continued (13)

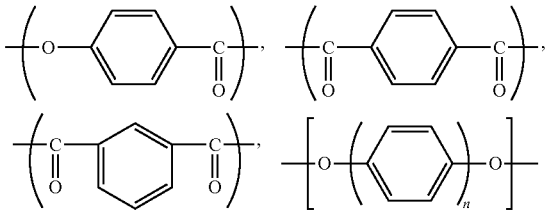

(14)

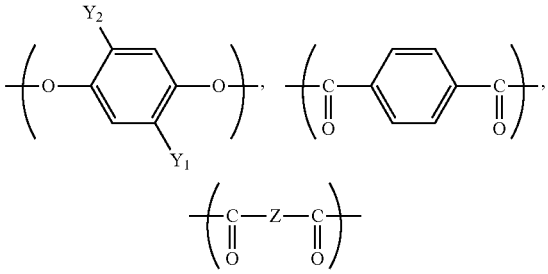

(15)

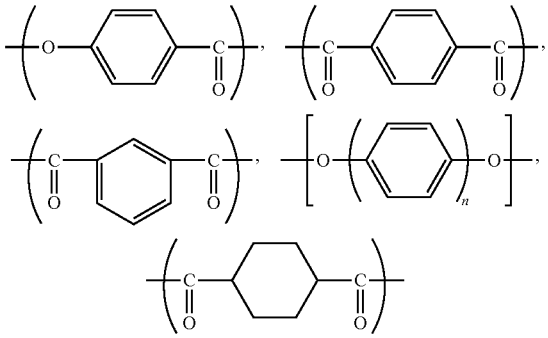

(16)

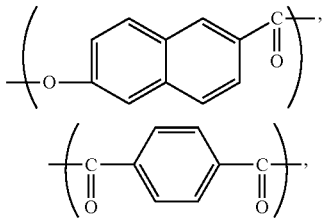

-continued

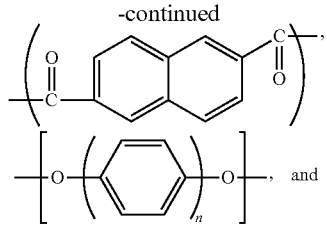

and (18)

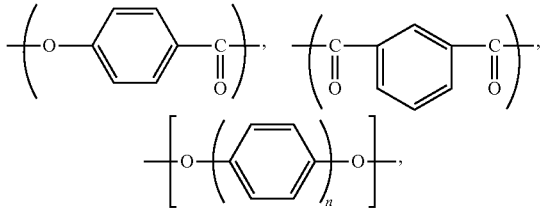

where n is an integer of 1 or 2, among each of the structural units, n=1 and n=2 may independently exist, or may exist in combination;

each of the $Y_1$ and $Y_2$ independently represents, a hydrogen atom, a halogen atom, an alkyl group, an alkoxy group, an aryl group, an aralkyl group, an aryloxy group, or an aralkyloxy group; and Z is a substitutional group represented by any one of the following formulae:

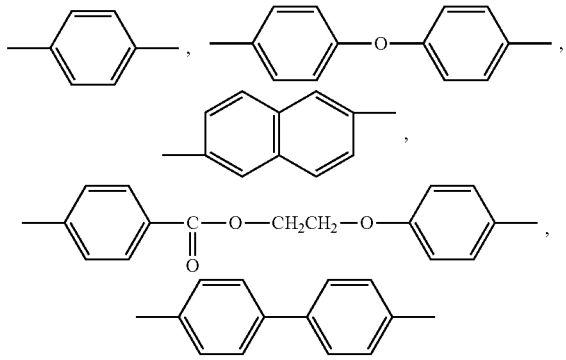

* * * * *